US012209474B2

(12) United States Patent
Perschke

(10) Patent No.: US 12,209,474 B2
(45) Date of Patent: Jan. 28, 2025

(54) LUBRICATOR FOR A WELL SYSTEM AND METHODS OF OPERATING SAME

(71) Applicant: Heshka Oil, Conroe, TX (US)

(72) Inventor: Malcolm Perschke, Conroe, TX (US)

(73) Assignee: HESHKA OIL, Conroe, TX (US)

( * ) Notice: Subject to any disclaimer, the term of this patent is extended or adjusted under 35 U.S.C. 154(b) by 0 days.

(21) Appl. No.: 18/309,818

(22) Filed: Apr. 30, 2023

(65) Prior Publication Data

US 2024/0360735 A1 Oct. 31, 2024

(51) Int. Cl.
*E21B 33/068* (2006.01)
*E21B 34/02* (2006.01)

(52) U.S. Cl.
CPC ..... *E21B 33/068* (2013.01); *E21B 34/02* (2013.01)

(58) Field of Classification Search
CPC ..... E21B 33/068; E21B 34/02
See application file for complete search history.

(56) References Cited

U.S. PATENT DOCUMENTS 334,690 A 1/1886 Craik
1,997,878 A * 4/1935 Wagner ..... F16L 55/132 220/233
3,275,023 A * 9/1966 Raspante ..... F16L 55/105 137/454.2
3,624,979 A 12/1971 Przybylski
4,184,504 A * 1/1980 Carmichael ..... E21B 33/068 137/15.13
4,448,247 A * 5/1984 Reed ..... E21B 37/00 166/85.1
4,503,879 A * 3/1985 Lazarus ..... F16L 55/128 138/94
5,358,010 A * 10/1994 Jiles ..... F16L 55/124 138/90
5,875,851 A 3/1999 Vick, Jr. et al.
6,199,628 B1 3/2001 Beck et al.
6,695,049 B2 * 2/2004 Ostocke ..... E21B 34/02 166/97.1

(Continued)

FOREIGN PATENT DOCUMENTS

WO WO 2006/061645 6/2006

OTHER PUBLICATIONS https://www.youtube.com/watch?v=7iOp0rPc1SE—Multi-Stage Double Acting Telescoping Cylinders Animation.

(Continued)

*Primary Examiner* — Steven A MacDonald
(74) *Attorney, Agent, or Firm* — NIXON & VANDERHYE P.C.

(57) ABSTRACT

A lubricator for a well system comprises at least one piston and at least one piston plug. The at least one piston is axially slidable within the lubricator along a lubricator axis. The at least one piston comprises a piston alignment contour of a surface of the at least one piston. The at least one piston plug is configured to limit an extent of axial displacement of the at least one piston, and comprises a piston plug alignment contour of a surface of the piston plug. The piston alignment contour and the piston plug alignment contour are configured to mate and automatically circumferentially align the at least one piston and the at least one piston plug about the axis upon travel of the at least one piston along the axis toward the at least one piston plug.

24 Claims, 16 Drawing Sheets

(56) References Cited

U.S. PATENT DOCUMENTS

| | | | | |
|---|---|---|---|---|
| 6,719,059 | B2 | 4/2004 | Dezen et al. | |
| 7,051,810 | B2 | 5/2006 | Clemens et al. | |
| 7,121,344 | B2 | 10/2006 | Fenton et al. | |
| 8,028,752 | B2 | 10/2011 | Richards | |
| 8,544,551 | B2 * | 10/2013 | Nguyen | E21B 34/02 166/368 |
| 8,555,986 | B2 | 10/2013 | Clemens et al. | |
| 9,382,777 | B2 | 7/2016 | Pettersen et al. | |
| 10,082,005 | B2 | 9/2018 | Salomonsen et al. | |
| 10,087,693 | B2 | 10/2018 | Bye | |
| 10,502,021 | B2 * | 12/2019 | Healy | E21B 47/06 |
| 11,530,592 | B2 | 12/2022 | Perschke | |
| 11,913,300 | B1 * | 2/2024 | Karakaya | E21B 34/02 |
| 2002/0017384 | A1 * | 2/2002 | Ostocke | E21B 34/02 166/85.1 |
| 2009/0194291 | A1 | 8/2009 | Fesi et al. | |
| 2012/0024521 | A1 | 2/2012 | Villa | |
| 2014/0216757 | A1 * | 8/2014 | Kleppa | E21B 34/02 166/377 |
| 2016/0258232 | A1 | 9/2016 | Harper | |
| 2018/0010420 | A1 * | 1/2018 | Shirley | F16K 15/063 |
| 2018/0080291 | A1 | 3/2018 | Sipos | |
| 2018/0179854 | A1 * | 6/2018 | Healy | E21B 47/00 |
| 2020/0040687 | A1 | 2/2020 | Kleppa | |
| 2022/0228462 | A1 * | 7/2022 | Guidry | E21B 33/12 |
| 2024/0035350 | A1 * | 2/2024 | Alamer | E21B 33/03 |

OTHER PUBLICATIONS

"Snubbing Operations" https://www.coursehero.com/file/56096173/Snubbingpdf/, by Wildwell Control.

* cited by examiner

LUBRICATOR FOR A WELL SYSTEM AND METHODS OF OPERATING SAME

TECHNICAL FIELD

The technology relates to lubricators for a well system and methods of operating such lubricators.

BACKGROUND

Inserting tools into or through well systems, including wellheads and oilfield Christmas trees, has been practiced for decades and is important for certain phases of well drilling, well completion, and well servicing. The process of inserting the tools is generally accomplished using apparatus commonly referred to as a "lubricator". A lubricator comprises one or more tubulars that form a sealed chamber around a downhole tool. In some configurations the lubricator may be mounted atop a Blowout Preventer (BOP), or Wellhead Christmas Tree. In other configurations, the tool may be inserted by the lubricator into the wellhead though one or more valves, such as gate valves. An example situation is when the tool which is inserted into the wellhead is a plug that closes off or plugs the interface between the wellhead and a valve when the valve needs to be removed, e.g., for maintenance or replacement. Another situation is when the tool is drill or other implement that may be used to remedy a problematic condition in the well system, such as a stuck or inoperable gate in the gate valve.

When wellheads are constructed onshore, they are usually constructed below ground level in what is termed a "cellar". In a cellar there is typically limited space between the outboard most valve and the cellar wall. This limited space between the outboard most valve and the cellar wall makes it very difficult to install a standard lubricator. The same is true for wellheads constructed offshore where space is limited due to all the steel work and piping that surrounds the wellhead.

When it is desired to perform a maintenance operation upon an aspect of the well system, a tool is installed on or included in or on a working end of the lubricator. For example, to remove a valve mounted to a wellhead, e.g., for maintenance or replacement of the valve, a valve removal (VR) plug is often employed. The VR plug is pushed through the open valves by the operation of the lubricator until the VR plug engages with a thread which is integral with the wellhead. The VR plug is then rotated manually and torqued in place by operation of the lubricator to provide a fluid/gas tight seal so that the valve may be removed without affecting other portions of the well system. As another example, to remove an obstacle or modify an interface surface of a gate valve, the tool that is mounted to our included on/in the lubricator may take the form of a drill or other abrading or surface modifying instrument.

Transportation of a tool, of which a VR plug is a non-exhaustive example, may be performed using a VR lubricator of the type shown in FIG. 1 and/or as described in U.S. Pat. No. 1,153,059 to Perschke, incorporated herein by reference in its entirety. Example VR and other lubricators are also described at https://www.heshkaoil.com/products/bpv-and-vr-lubricators/and https://www.heshkaoil.com/back-pressure-valve-pressure-balanced-manually-operated-lubricator.

The lubricator is typically mounted to the outboard most horizontally mounted valve attached to the wellhead. Depending on the stroke required, the lubricator units 47 can be up to 80" long. The lubricator is designed to contain pressure while manually moving a polished rod with the VR plug distally attached to it toward the wellhead receptacle. The polished rod is then rotated by operation of the lubricator, either clockwise or counterclockwise, depending on whether the VR plug is being installed or retrieved.

Current lubricators typically require special tooling to move the polished rod in and out of the valve along the axis of the bore. An example of such special tooling may be a Parmelee Wrench, which typically wraps around the polished rod that extends through the Lubricator and is used to clamp the rod and manually rotate it. The same special tooling is used to rotate the polished rod that is connected to the VR plug. This special tool, if not used properly, can damage the sealing surface of the rod which in turn may damage the seals in yokes of the lubricator when it is manipulated in or outward from the lubricator rendering the seal barriers ineffective exposing the operator and environment to contamination.

The technology disclosed herein seeks to mitigate or eliminate various disadvantages involved in the construction and use of prior art lubricators.

SUMMARY

In one of its example embodiments and modes, the technology disclosed herein concerns a lubricator for a well system. In a generic example embodiment and mode, the lubricator comprises at least one piston and at least one piston plug. The at least one piston is axially slidable within the lubricator along a lubricator axis. The at least one piston comprises a piston alignment contour of a surface of the at least one piston. The at least one piston plug is configured to limit an extent of axial displacement of the at least one piston, and comprises a piston plug alignment contour of a surface of the piston plug. The piston alignment contour and the piston plug alignment contour are configured to mate and automatically circumferentially align the at least one piston and the at least one piston plug about the axis upon travel of the at least one piston along the axis toward the at least one piston plug.

In an example embodiment and mode, the lubricator further comprises an essentially cylindrical and essentially hollow housing positioned about a lubricator axis; a lubricator adaptor flange configured for attachment to a valve; and an essentially cylindrical drive cylinder at least partially axially extending through an interior of the housing. The at least one piston is axially slidable relative to the drive cylinder.

In an example embodiment and mode, the piston alignment contour of the surface of the at least one piston comprises piston alignment projection on an outer circumferential surface of the at least one piston, and the piston plug alignment contour of the surface of the piston plug comprises piston plug alignment cavities on an interior surface of the piston plug. The piston alignment projections and the piston plug alignment cavities are configured so that upon travel of the at least one piston along the axis the piston alignment projections automatically align circumferentially about the axis as the at least one piston enters an interior of the piston plug and is retained in position in the piston plug, In another of its example embodiments and modes, the technology disclosed herein concerns a method of operating a lubricator for a well system. In a generic example embodiment and mode, the method comprises driving at least one piston within the lubricator along a lubricator axis toward a piston plug and automatically aligning a piston alignment contour of a surface of the at least one piston with a piston plug alignment contour formed on a surface of a piston plug as the at least one piston mates with the at least one piston plug; and retaining at least one piston alignment within the at least one piston plug.

In an example embodiment and mode, the method further comprises attaching the lubricator to a valve, the valve being connected to a wellhead of the well system; and, upon retention of the at least one piston in the piston plug, rotating the at least one piston to perform a maintenance operation within the well system.

In an example embodiment and mode the piston alignment contour comprises piston alignment projections formed on an outer circumferential surface of the at least one piston and the piston plug alignment contour comprises piston plug alignment cavities formed on an interior surface of a piston plug, and the method further comprises: driving at least one piston within the lubricator along a lubricator axis toward a piston plug and automatically the aligning piston alignment projections formed on the outer circumferential surface of the at least one piston with the piston plug alignment cavities formed on the interior surface of the piston plug as the at least one piston enters an interior of the at least one piston plug; and retaining at least a portion of the piston alignment projections in the piston plug.

BRIEF DESCRIPTION OF THE DRAWINGS

The foregoing and other objects, features, and advantages of the technology disclosed herein will be apparent from the following more particular description of preferred embodiments as illustrated in the accompanying drawings in which reference characters refer to the same parts throughout the various views. The drawings are not necessarily to scale, emphasis instead being placed upon illustrating the principles of the technology disclosed herein.

DETAILED DESCRIPTION

In the following description, for purposes of explanation and not limitation, specific details are set forth such as particular architectures, interfaces, techniques, etc. in order to provide a thorough understanding of the technology disclosed herein. However, it will be apparent to those skilled in the art that the technology disclosed herein may be practiced in other embodiments that depart from these specific details. That is, those skilled in the art will be able to devise various arrangements which, although not explicitly described or shown herein, embody the principles of the technology disclosed herein and are included within its spirit and scope. In some instances, detailed descriptions of well-known devices, circuits, and methods are omitted so as not to obscure the description of the technology disclosed herein with unnecessary detail. All statements herein reciting principles, aspects, and embodiments of the technology disclosed herein, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Thus, for example, it will be appreciated by those skilled in the art that block diagrams herein can represent conceptual views of illustrative circuitry or other functional units embodying the principles of the technology. Similarly, it will be appreciated that any flow charts, state transition diagrams, pseudo code, and the like represent various processes which may be substantially represented in computer readable medium and so executed by a computer or processor, whether or not such computer or processor is explicitly shown.

The technology disclosed herein generally relates to a lubricator with rotation capability for installing and retrieving or otherwise operating a tool, such as a valve removal (VR) plug or a drill, in a wellhead. For example, the technology 182 disclosed herein relates to a hydraulically operated lubricator for installing and retrieving VR plugs installed in a wellhead located in a tight cellar or tight offshore installation area restricted by structures close to the wellhead where a standard manual lubricator may not fit.

Figure 2:
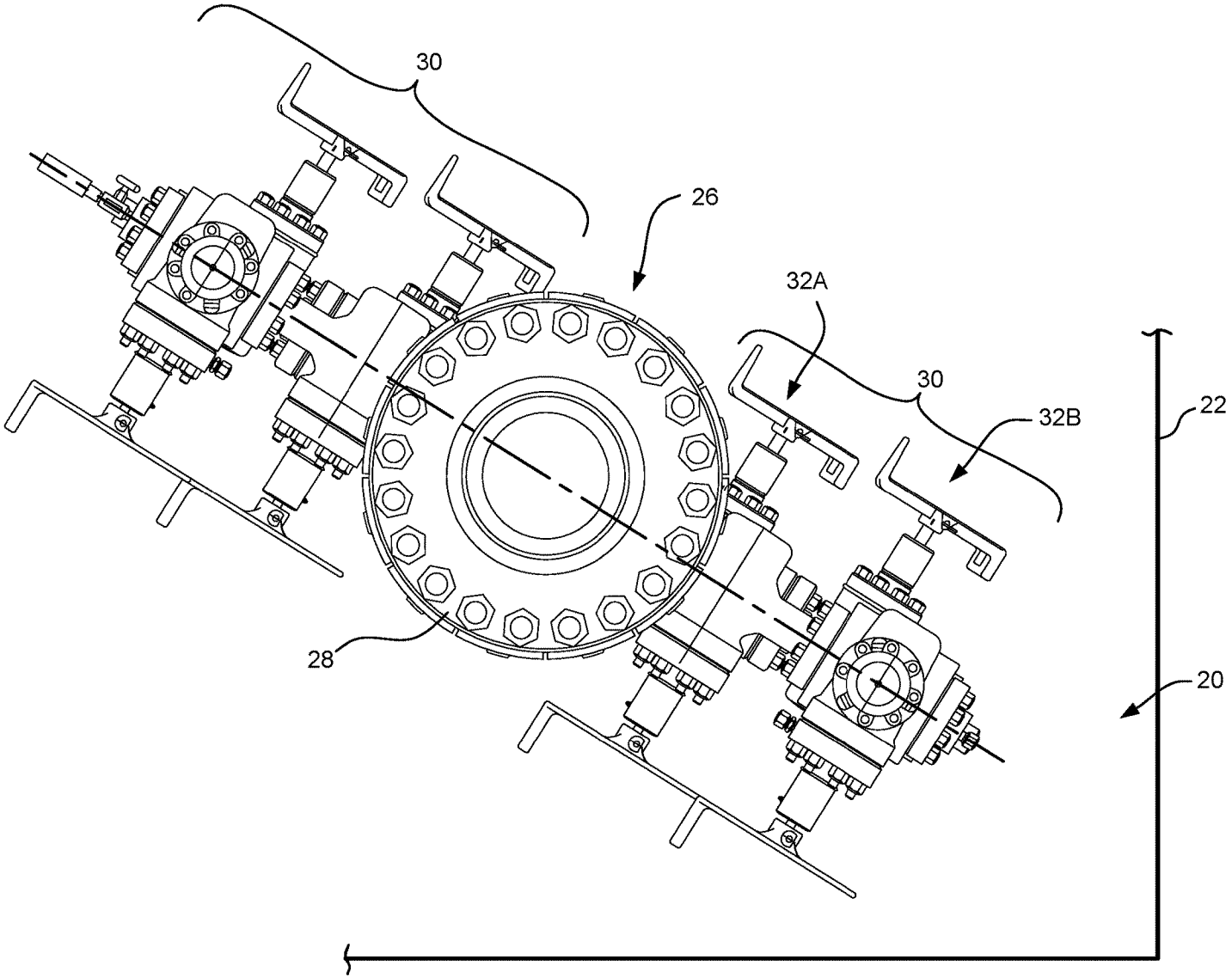
FIG. 2 is a top plan view of an example wellhead and portions of a typical cellar.
Figure 3:
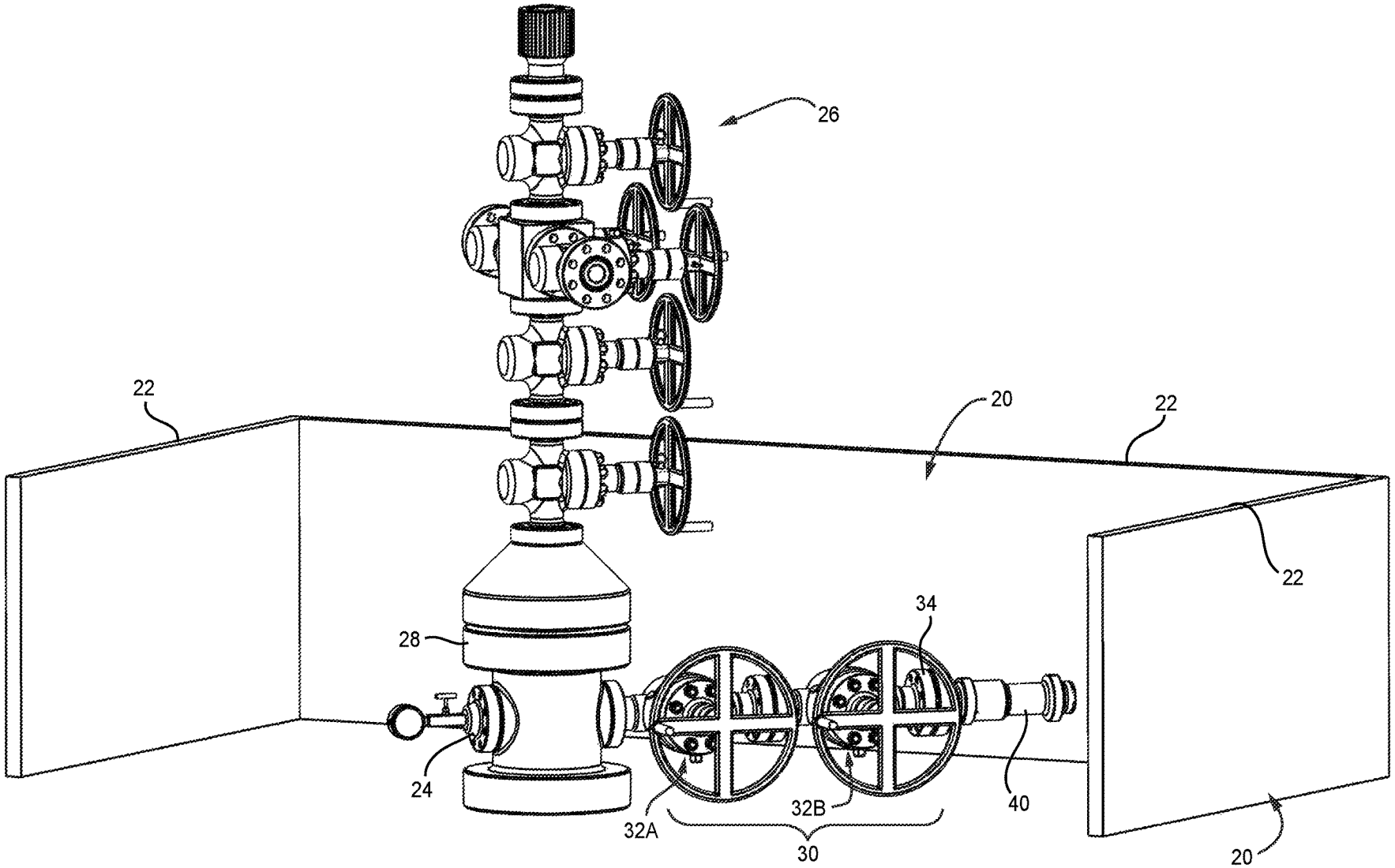
FIG. 3 is an isometric view of an example wellhead located in a cellar, and further showing a lubricator connected to an outboard most of two gate valves.

FIG. 2 and FIG. 3 show a generic example of cellar area 20 defined, at least in part, by cellar walls 22. FIG. 2 and FIG. 3 further show a wellhead tree 26, a wellhead 28, and associated equipment such as one or more gate valve assemblies 30 and test flanges 24 installed in the cellar area 20. A test flange blocks off the flow path to the environment from the well and usually has a pressure gauge attached to it so they can know if there is pressure in the wellhead annulus. The components which are situated in the cellar area 20 for productive operation and maintenance of the wellhead 28, including the wellhead tree 26 and one or more gate valve assemblies, are collectively referred to herein as the well system.

The location and orientation of the structures within cellar area 20 is decided upon during a well planning stage to provide maximum horizontal space between the outermost portion of the gate valve assembly 30, i.e., the portion of the gate valve assembly 30 most distant from the wellhead tree 26, mounted horizontally on the wellhead, and the walls 22 of the cellar area 20. In some situations, the distance between the outermost portion of the gate valve assembly 30 and the cellar walls 22 can be in a range between 24"-54". It is the tighter distances that require the need for a solution that can traverse either 1 or 2 gate valves.

Figure 1:
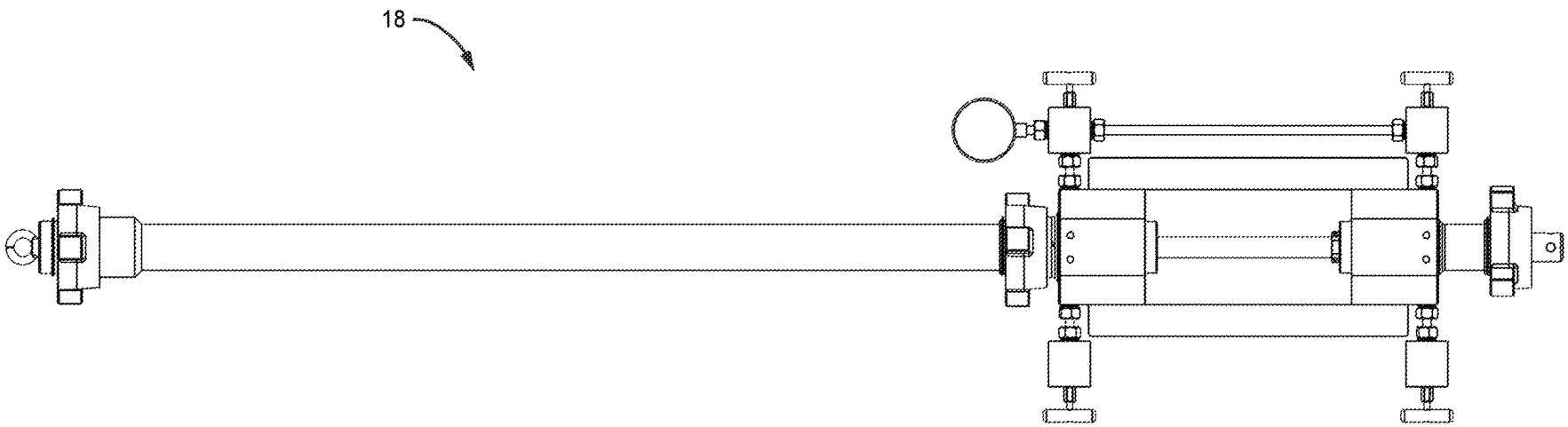
FIG. 1 is a top view of a conventional lubricator.

As mentioned above, FIG. 1 shows a generic example of a prior art VR lubricator with an end configured to be mountable to a flange of a gate valve assembly and subsequently used to install or retrieve a VR plug. Prior art VR lubricators such as lubricator 18 may vary in length from 58" to 80" to cover either a single valve or double valve arrangement mounted to the wellhead. In contrast to prior art lubricators, the lubricators of example embodiment and modes described herein may have a length of 18 inches between its extremities, i.e., between its point of connection/attachment to a gate valve and its driven end, e.g., between lubricator flange adapter and a drive plug as described herein. The significantly short overall length of the lubricators of example embodiment and modes described herein thus addresses problems of operating in relatively small cellar areas 20.

Figure 4:
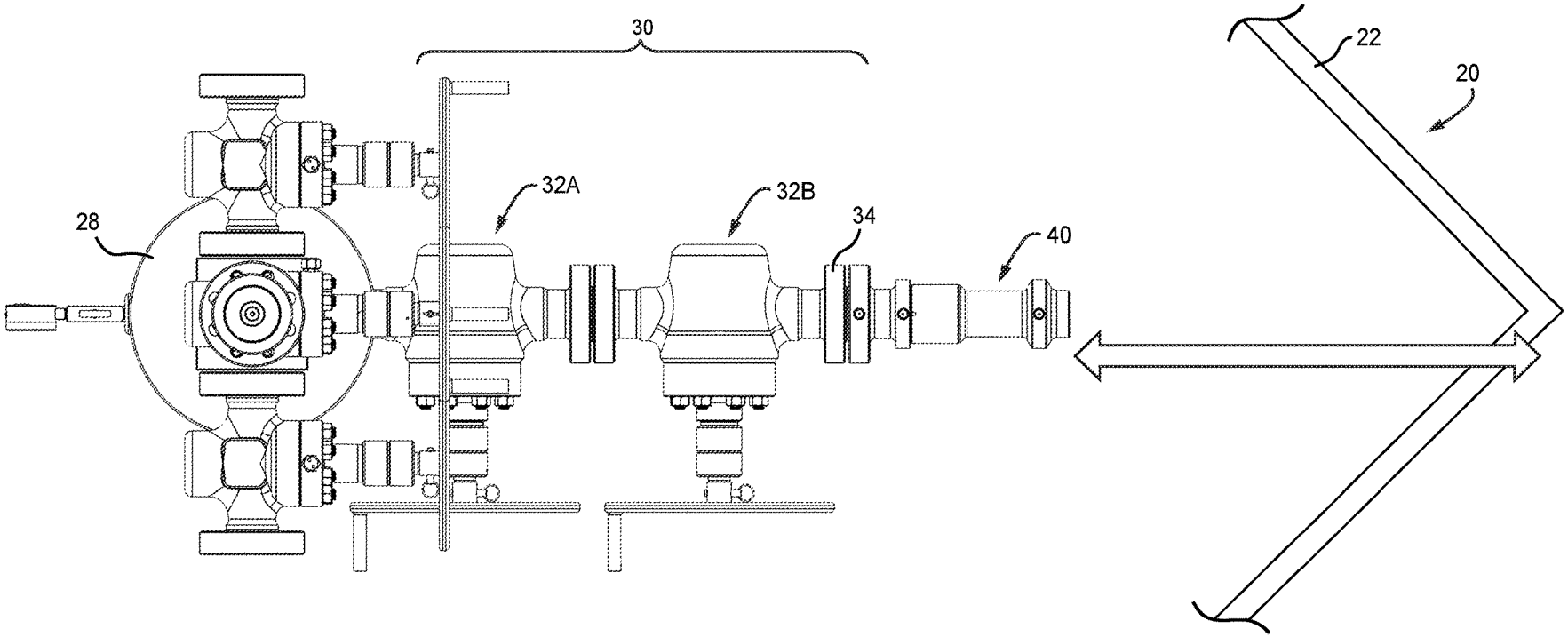
FIG. 4 is a top view of the wellhead, gate valves, and lubricator, and portions of the cellar of FIG. 3.
Figure 7:
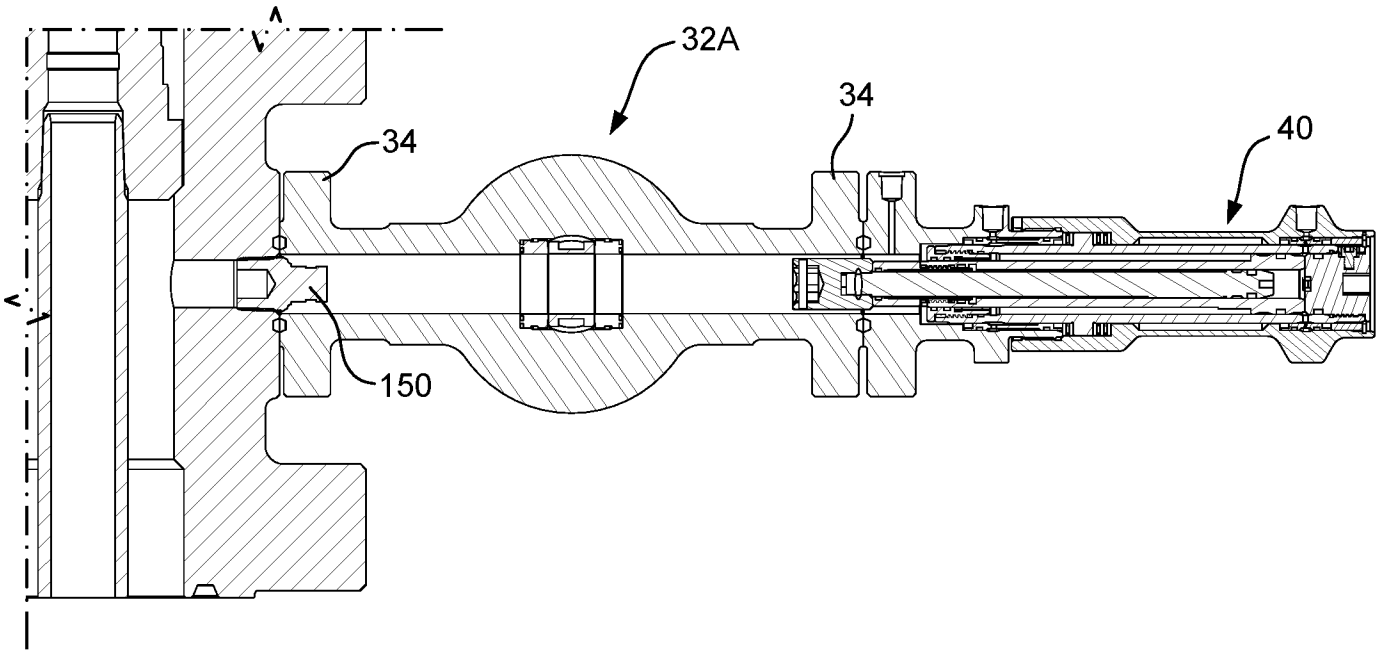
FIG. 7 is a partially sectioned side view of the lubricator of FIG. 5 mounted to the single gate valve of FIG. 6 but with lubricator pistons retracted and VR plug threaded into wellhead.
Figure 8:
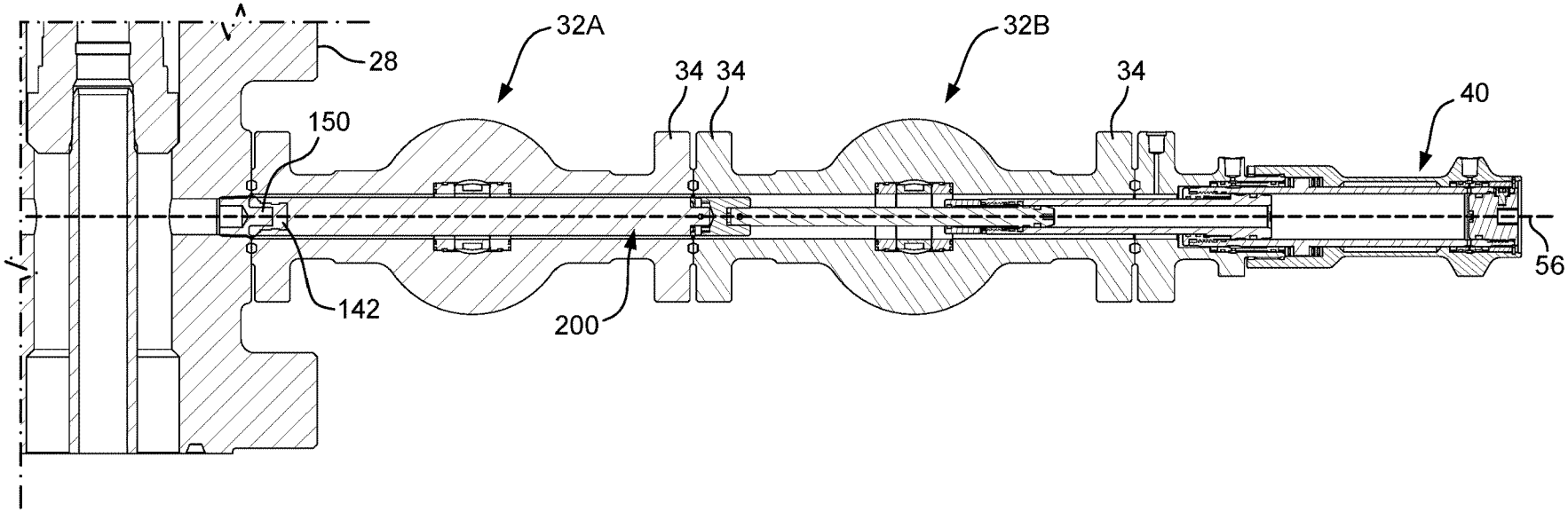
FIG. 8 is a partially sectioned side view of the lubricator of FIG. 5 mounted with lubricator pistons extended so as to extend through a two gate valves, the two gate 135 valves being connected in series to a wellhead whereat the lubricator has engaged a VR plug.

A gate valve assembly 30 may include a double valve arrangement in which two gate valves 32A and 32B are shown connected horizontally in series as shown in FIG. 3, FIG. 4, and FIG. 8. Alternatively, the gate valve assembly 30 may comprise a single gate valve such as gate valve 32A as shown in FIG. 7.

Gate valves typically comprise gate valve flanges, such as gate valve flange 34 shown in FIG. 4, to which a gate valve may be connected either to the wellhead 28, to another gate valve, or to a lubricator such as lubricator 40 described herein. For example, FIG. 3 and FIG. 4 show a generic set up of a well system comprising wellhead 28 in which gate valve assembly 30 comprises two gate valves 32A and 32B.

FIG. 3 further shows lubricator 40 according to an example embodiment and mode connected to the valve flange 34 of the outermost gate valve 32B in preparation of a well system maintenance operation, e.g., delivering a valve removal plug 150, i.e., VR plug 26 shown in FIG. 8, to the wellhead 28.

Figure 5:
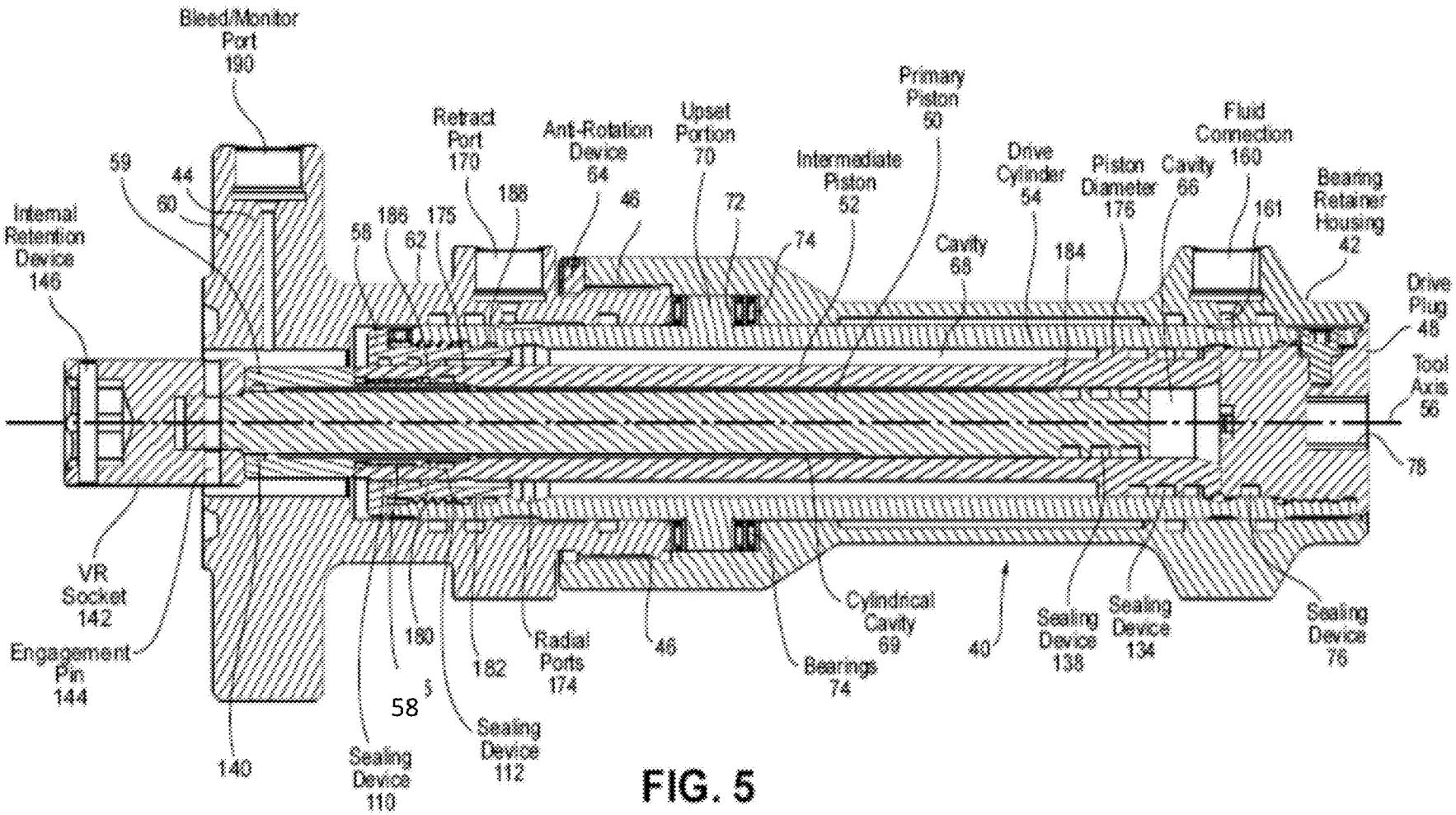
FIG. 5 is a sectioned side view of a lubricator according to an example embodiment and mode in which pistons of the lubricator are retracted.
Figure 6:
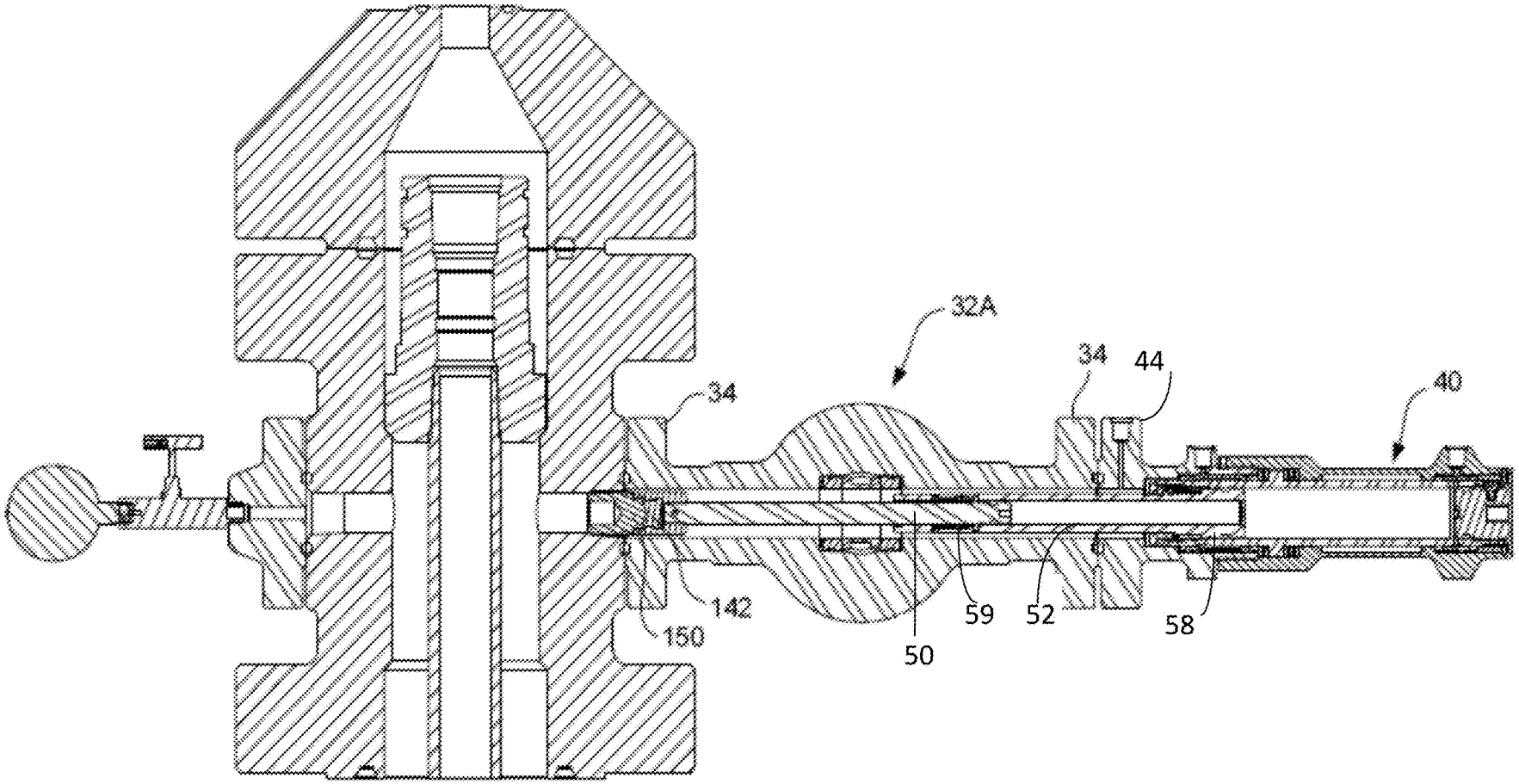
FIG. 6 is a partially sectioned side view of the lubricator of FIG. 5 mounted with lubricator pistons extended so as to extend through a single gate valve, the single gate valve being connected to a wellhead whereat the lubricator has engaged a VR plug.

The lubricator 40 is shown in cross section and detail in FIG. 5. FIG. shows lubricator assembly in a state that is ready for mounting to the valve. FIG. 6 shows the lubricator assembly connected to the valve. As seen from its exterior, lubricator 40 comprises lubricator housing 42, also known as bearing retainer housing 42, and lubricator flange adapter 44, also known as attachment flange 44. The lubricator flange adapter 44 is threading inserted into a non-driven end of the lubricator housing 42 of lubricator 40 as shown by mating counter-threads 46. An opposite or driven end of lubricator housing 42 internally receives drive tool engagement plug 48. The drive tool engagement plug 48 receives a drive tool that may be used, e.g., to rotate lubricator 40, and is not to be confused with the tool, such as VR plug 150, that may be attached to the working or distal end of lubricator 40.

Lubricator 40 may comprise one or more pistons and associated one or more piston plugs, all concentrically arranged when the pistons are not extended in a drive cylinder. For example, a two-piston example embodiment and mode as illustrated in FIG. 5, internal components of lubricator 40 comprise primary piston 50, intermediate piston 52, and drive cylinder 54, all of which are concentrically arranged and situated outwardly in the mentioned order from a longitudinal axis 56 of lubricator 40. At its extended end, which is the piston end closest to flange adapter 44, each piston, whether 247 in the one piston example embodiment and mode or the multi-piston example embodiment and mode, mates with a respective drive plug. For example, in the two piston example embodiment and mode of FIG. 5 the intermediate piston 52 mates with intermediate piston drive plug 58 and the primary piston 50 mates with primary piston drive plug 59.

The technology disclosed herein encompasses multi-piston example embodiments and modes, such as the example two piston embodiment and mode of FIG. 5. In the sense of "multi-piston", it should be understood that more than two pistons may be utilized, with additional pistons between the proximal and distal pistons also potentially structured and operating in similar manner as the pistons described herein. Furthermore, the technology disclosed herein also encompasses a one piston example embodiment and mode. The one piston example embodiment and mode comprises primary piston 50 with its primary piston drive plug 59, but not intermediate piston 52 nor its intermediate piston drive plug 58.

The flange adapter 44 is situated at the left axial end of lubricator 40 as shown in FIG. 5 and comprises a generally cylindrical flange adapter base plate 60 from which axially extends rightward in FIG. 5 a flange adapter coupling neck portion 62. Both the flange adapter base plate 60 and the flange adapter coupling neck portion 62 are generally cylindrical and have a bore extending centrally therethrough. The outer diameter of the flange adapter base plate 60 is greater than the diameter of the flange adapter coupling neck portion 62.

When installed, the lubricator flange adapter 44 may be fixed to the flange 34 of the gate valve assembly 30. The bearing retainer housing 42 is threadably connected to the flange adapter 44 and locked in place with an anti-rotation device 64. The anti-rotation device 64 may take the form of a socket set screw, or a key(s), or a pin(s). The anti-rotation device 64 prevents the bearing retainer housing 42 from backing off when the drive cylinder 54 is rotating counter-clockwise.

Various internal components of the lubricator 40 were mentioned above for the two piston embodiment of FIG. 5 as basically comprising primary piston 50 with its primary piston drive plug 59, intermediate piston 52 with its intermediate piston drive plug 58, and drive cylinder 54. These internal components are essentially cylindrical, with all but primary piston 50 being hollow or having a through hole to accommodate another component(s). The primary piston 50, which is preferably solid, is concentrically surrounded by intermediate piston 52. A hollow essentially cylindrical cavity 68 is interposed between intermediate piston 52 and the drive cylinder 54 which concentrically surrounds the intermediate piston 52. Similarly, a hollow essentially cylindrical cavity 69 is interposed between intermediate piston 52 and the primary piston 50.

On its outer cylindrical surface drive cylinder 54 comprises a radially protruding or radially upset section 70. The axial surface of the radially protruding upset section 70 essentially provides location faces 72 for bearings 74. The bearings 74 are concentric around drive cylinder 54 and essentially ensure free movement between drive cylinder 54 and various fixed components such as flange adapter 44 and bearing retainer housing 52.

Drive tool engagement plug 48 includes a sealing device 76. The sealing device 76 may comprise, for example, an O-ring that is accommodated in a circumferential groove of tool engagement plug 48. Tool engagement plug 48 may include a drive tool engagement cavity or receptacle 78 at an end thereof farthest from the lubricator attachment flange 44.

Figure 9A:
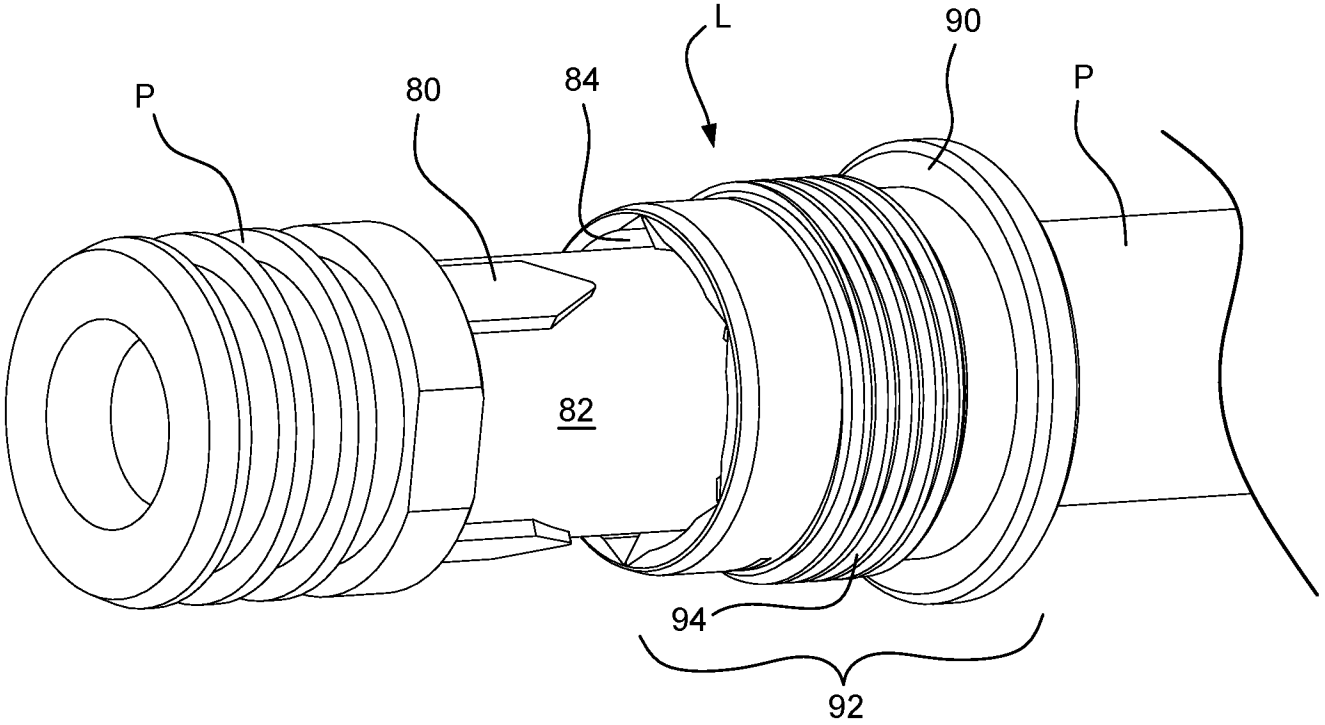
FIG. 9A is an isometric view showing a first example embodiment and mode of automatically or self-aligning structure of the lubricator of FIG. 5, including a piston comprising piston alignment projections on an outer circumferential surface of the piston and a piston plug configured to align with and to limit an extent of axial displacement of the piston.
Figure 9B:
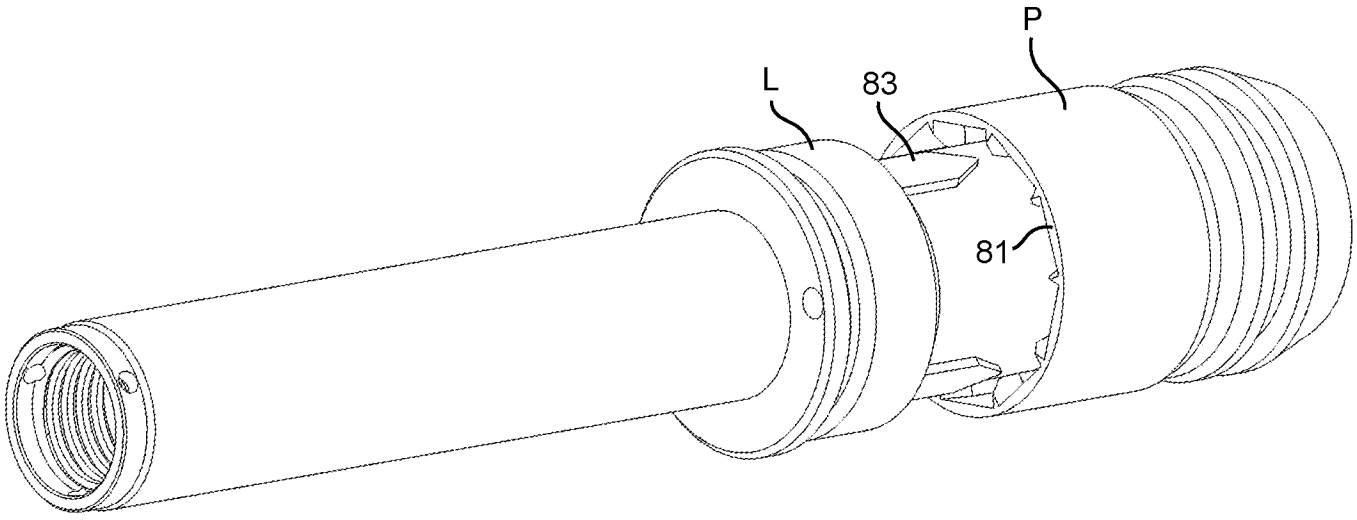
FIG. 9B is an isometric view showing a second example embodiment and mode of automatically or self-aligning structure of the lubricator of FIG. 5, including a piston comprising piston alignment cavities on an inner surface of the piston and a piston plug comprising piston alignment projections configured align with and to limit an extent of axial displacement of the piston.

Since the technology disclosed herein encompasses both a single piston example embodiment and mode and a multi-piston example embodiment and mode, the lubricator described herein comprises at least one piston axially slidable within the lubricator along a lubricator axis and a corresponding piston plug. FIG. 9A and FIG. 9B show in representative manner an example or generic piston P and example representative or generic plug L. Being representative, the piston P could correspond to either intermediate piston 52 or primary piston 50, and the plug L could correspond to either primary piston drive plug 59 or intermediate piston drive plug 58, depending on which of primary piston 50 or intermediate piston 52 is assumed shown in FIG. 9A and FIG. 9B. FIG. 9A and FIG. 9B show different configurations of piston alignment contours and plug alignment contours, as herein described.

FIG. 9A further shows that the piston P, which is also known herein as "the at least one piston" comprises piston alignment projections 80 on an outer circumferential surface 82 of piston P; and that the plug L comprises piston plug alignment cavities 84 on an interior surface of the piston plug L. Both the piston alignment projections 80 and the piston plug alignment cavities 84 are piston alignment contour features, with the piston alignment projections 80 being a plurality of piston alignment contour features circumferentially provided on a surface of the at least one piston P and the piston plug alignment cavities 84 being a plurality of piston plug alignment contour features circumferentially provided on a surface of the piston plug L. The piston plug L is configured to receive an extending end of the piston P in such a manner that, as the piston P is received in and at least part of piston P travels and extends completely through plug L, the piston is automatically circumferentially aligned within the plug L into a locking relationship so that torque applied to the piston P may be transmitted to plug L and to other elements connected to plug L. The plug L also serves to limit an extent of axial displacement of the at least one piston P, e.g., so that the proximal end of the piston P is preferably retained within the plug L. Thus, the piston alignment projections 80 and the piston plug alignment cavities 84 are configured so that upon travel of the at least one piston P along the lubricator axis 56 the piston alignment projections 80 automatically mate or align circumferentially about the axis as the at least one piston P enter and travels through an interior of the piston plug L and is are retained in position in the piston plug L.

The automatic circumferential alignment of the at least one piston P and the at least one piston plug L may occur due to other alignment contours than those shown in FIG. 9A. That is, in a more general example embodiment and mode, the at least one piston may comprises a piston alignment contour features of a surface of the at least one piston and the piston plug may comprise piston plug alignment contour features of a surface of the piston plug, and the piston alignment contour features and the piston plug alignment contour features are configured to mate and automatically circumferentially align the at least one piston and the at least one piston plug about the axis upon travel of at least part of the at least one piston along the axis toward and completely through the at least one piston plug. As such, the piston alignment contour features may be one or more projections on an outer circumferential surface as shown in FIG. 9A or, alternatively, one or more cavities on an inner surface. Correspondingly the piston plug alignment contour features maybe one or more cavities on an inner surface as shown in FIG. 9A, or alternatively one or more projections on an outer circumferential surface. An example of such an alternative arrangement is shown in FIG. 9B, wherein the piston alignment contour features comprises one or more cavities on an inner surface of piston P, and the piston plug alignment contour features comprises one or more projections 83 on an outer circumferential surface of piston plug L. Although the ensuing discussion primarily refers to the example embodiment and mode of FIG. 9A as an example, it does so only in representative manner such that the ensuing discussion of structure and operation is also applicable to the example embodiment and mode of FIG. 9B. For example, aspects of the structure and operation of the piston alignment projections 80 as provided on the piston P of FIG. 9A may be applicable to the plug alignment projections 83 provided on the plug L of FIG. 9B, and aspects of the structure and operation of the plug alignment cavities 84 as provided on the plug P of FIG. 9A may be applicable to the piston alignment cavities 81 provided on the piston P of FIG. 9B. To accommodate the alternative configuration of FIG. 9B, the lubricator 40 may differ in some respects such as location and orientation of threading and manner of retention to hold the plug L in place and also enable rotation.

As shown in FIG. 9A, at an end closest to the lubricator flange adapter 44 the representative drive plug L comprises a piston drive plug shoulder portion 90 of greater diameter than a piston drive plug neck portion 92. The neck portion 92 of the drive plug L has a portion thereof comprising exterior threads 94 for engagement with a member of lubricator 40 in which it is retained. In the case of intermediate piston drive 354 plug 58, the retaining member is the drive cylinder 54; in the case of primary piston drive plug 59 the retaining member is intermediate piston 52. Drive plug shoulder portion of intermediate piston drive plug 58 is herein also referred to as drive plug shoulder portion 90I, while drive plug neck portion of primary piston drive plug 59 is herein also referred to as drive plug neck portion 92P. For structures of the pistons and piston plugs described herein, the suffix "P" follows reference numbers for elements of the primary piston 50 and primary piston drive plug 59, while the suffix "I" follows reference numbers for elements of intermediate piston 52 and intermediate piston drive plug 58.

The plug L is locked to its retaining member in a similar fashion as is the bearing retainer housing 42 to lubricator flange adapter 44. For the two piston example embodiment and mode, both the shoulder portion 90I and neck portion 92I of intermediate piston drive plug 58 have a central bore extending therethrough which accommodates primary piston 50.

Figure 10:
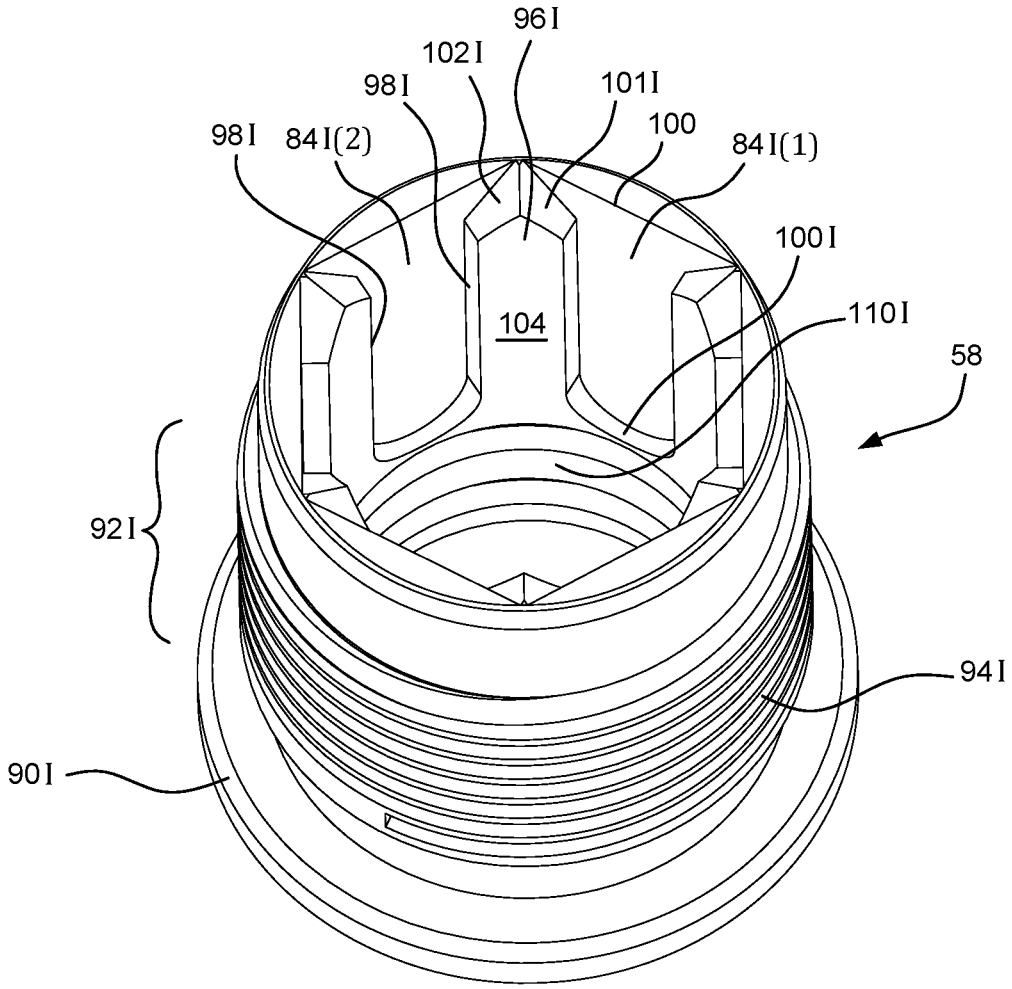
FIG. 10 is an isometric view of the piston plug of FIG. 9A.
Figure 11:
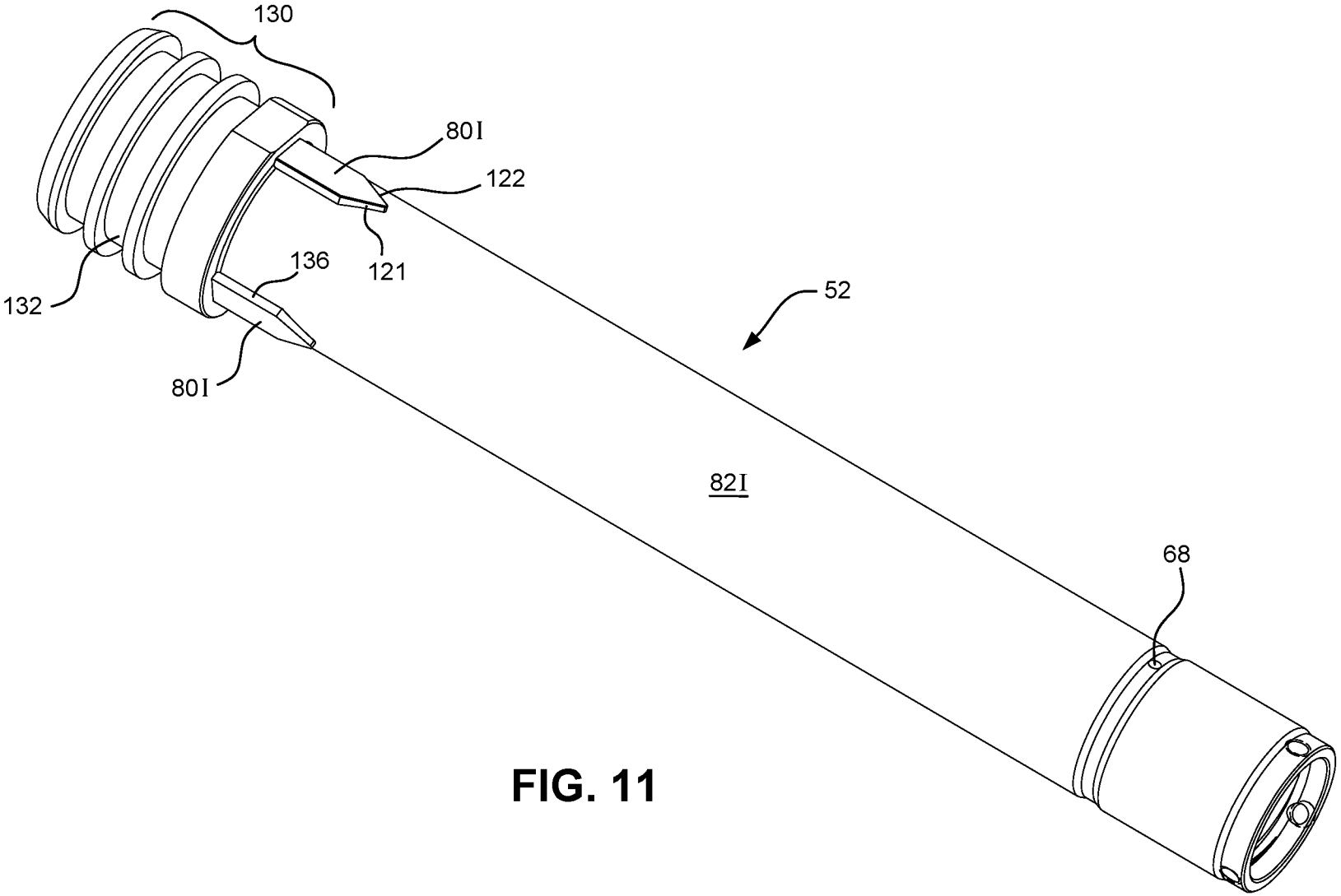
FIG. 11 is a side view of an intermediate piston of the lubricator of FIG. 5.
Figure 12:
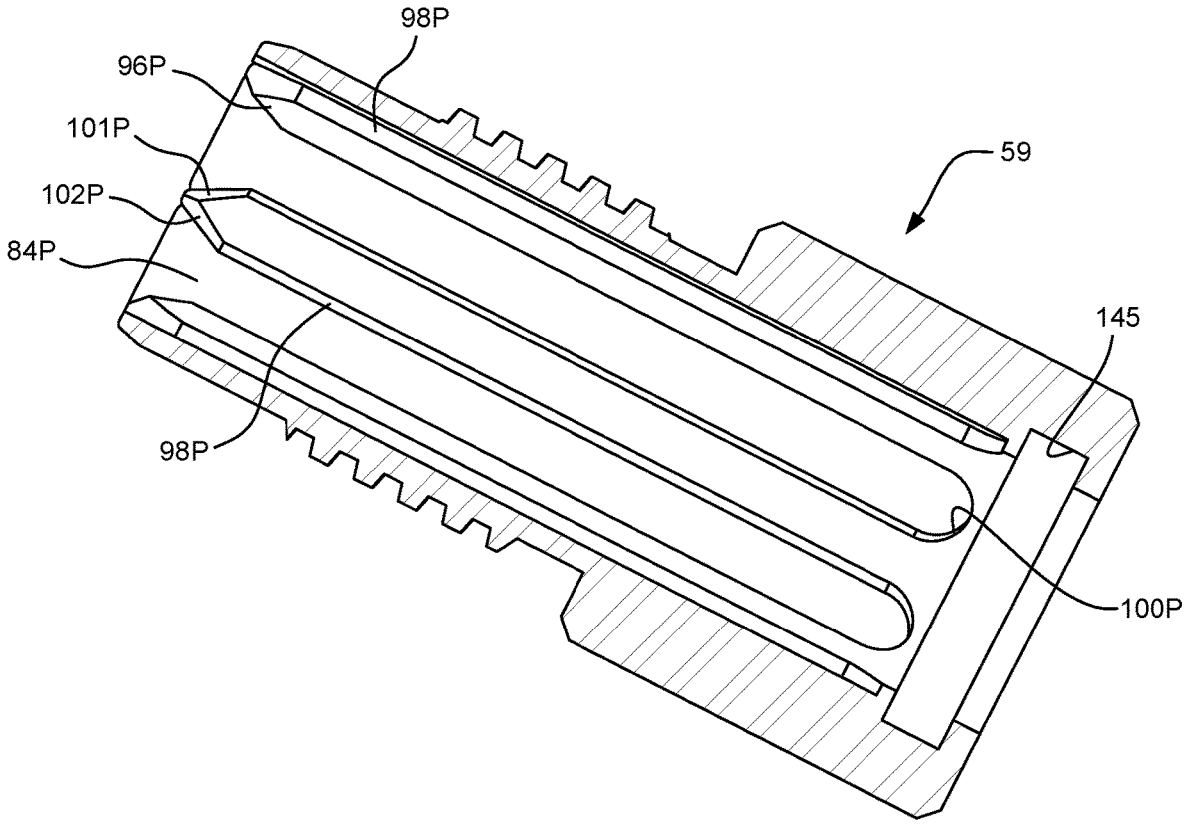
FIG. 12 is sectioned side view of an interior portion of a primary piston 150 plug of the lubricator of FIG. 5.
Figure 13:
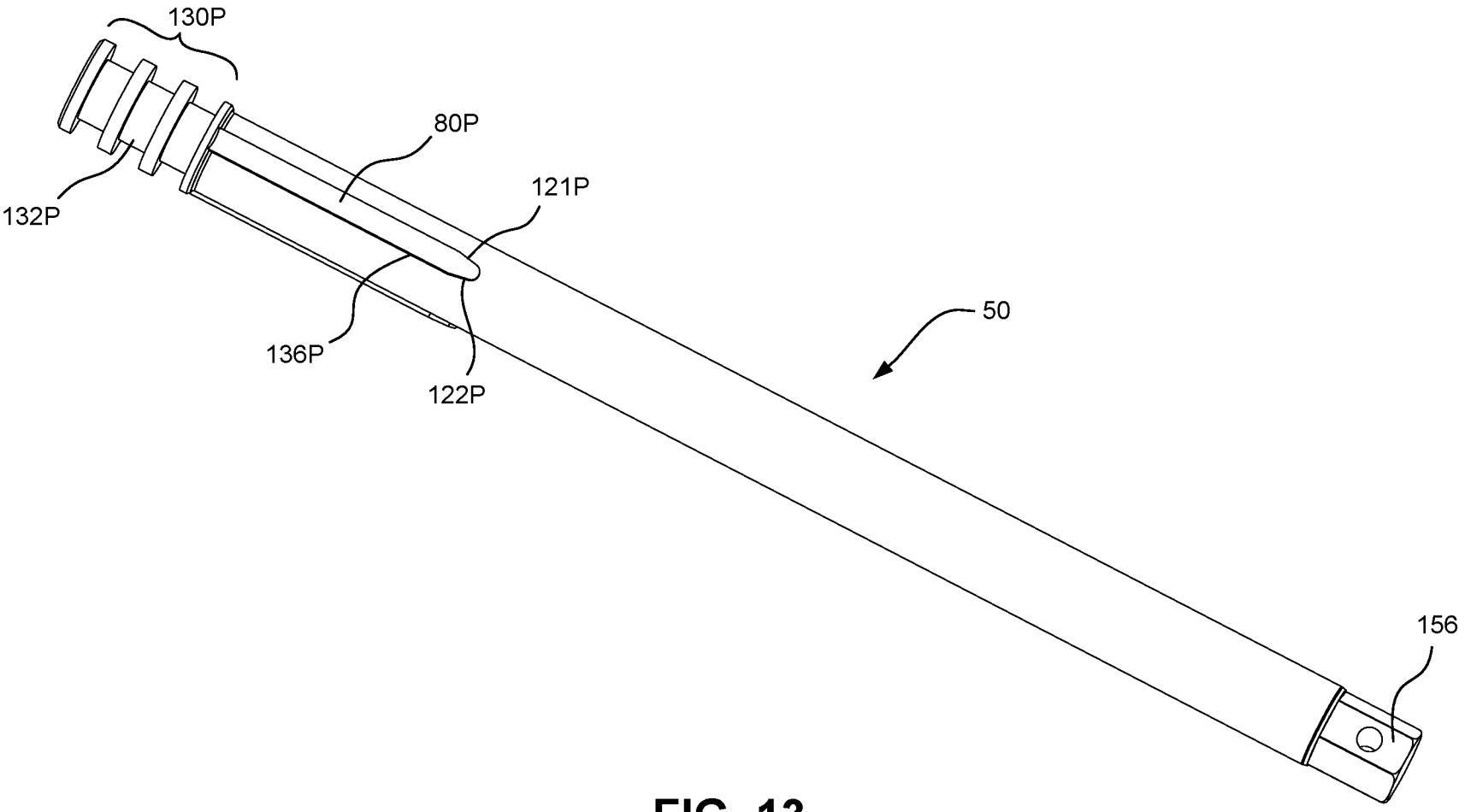
FIG. 13 is a side view of a primary piston of the lubricator of FIG. 5.

While the structures of primary piston 50 and its primary piston drive plug 59 are similar in many respects to the structures of intermediate piston 52 and its intermediate piston drive plug 58, it should be understood that for the two piston example embodiment and mode of FIG. 5 that the diameters of primary piston 50 and primary piston drive plug 59 are smaller than the diameters of intermediate piston 52 and intermediate piston drive plug 58, since primary piston 50 is concentric to but interior to intermediate piston 52. FIG. 10 and FIG. 11 show aspects of the intermediate piston 52 and intermediate piston drive plug 58, respectively, while FIG. 12 and FIG. 13 shows aspects of the primary piston 50 and primary piston drive plug 59, respectively.

FIG. 10 shows drive cylinder intermediate piston drive plug 58 including an interior thereof in greater detail. Included in neck portion 92I of intermediate piston drive plug 58 is an internally machined self-alignment feature. For example, the piston plug alignment cavities 84I are formed between adjacent teeth 96I provided on an interior surface of the intermediate piston drive plug 58. Each cavity 84I is at least partially defined by a cavity wall 98I provided by a radial lateral surface one of the 384 adjacent teeth 96I. Each cavity 84I is further at least partially defined by portion of an interior surface 100 of the piston plug. The interior surface 100 of the piston plug may be circular or non-circular. Preferably but not exclusively the interior surface 100 of the piston plug is in a shape of a polygon in a plane perpendicular to the axis 56, with each tooth having 96I having a tooth cap which is situated essentially at a vertex of the 389 polygon. The interior surface 100 may have the shape of a hexagon in a non-limiting example embodiment and mode, but other non-circular shapes are also encompassed hereby including a quadrilateral, pentagon, octagon, etc.

Each tooth 96I provided on the interior surface of the intermediate piston drive plug 58 comprises two ramp surfaces 101I and 102I that are angled circumferentially from a mouth rim of the intermediate piston drive plug 58. One of the two ramp surfaces, e.g., ramp surface 101I in FIG. 10, is connected to a first cavity 84I(1) on a first side of the tooth 96I(1), and a second of the two ramp surface, i.e., ramp surface 102I, is connected to a second cavity 84I(2) on a second side of the tooth 96I(1).

The teeth 96I provided on the interior surface of the intermediate piston drive plug 58 preferably have an arcuate interior face 104. The arcuate interior faces 104 of plural teeth at least partially form an imaginary cylinder about the axis at a diameter sufficient to accommodate the primary piston primary piston 50.

Thus, at a mouth of intermediate piston drive plug 58, i.e., at an end of the neck portion 92I of intermediate piston drive plug 58 that is farthest from its shoulder portion 90I, the outer circumference or outer rim of neck portion 92I is circular. However, an inner rim of the mouth of neck portion 92I is polygonal, preferably essentially hexagonal. At each vertex of the hexagon of the inner rim, two vertices of two adjoining quadrilateral angled surfaces or ramps 101I and 102I co-terminate. Edges of the two adjoining angled or ramped surfaces 101I and 102I that have first ends that terminate at the hexagon vertex also bisect the interior angle of the hexagon at the vertex and coextensively extend both partially interiorly toward a central axis of intermediate piston drive plug 58 and away from the mouth into a throat of intermediate piston drive plug 58. Those two edges co-terminate at an inner circumferential peak.

Thus, a pair of angled surfaces 101I, 102I are provided at each vertex of the hexagonal neck portion 92I of inner rim of the mouth of intermediate piston drive plug 58. At each vertex the angled surfaces 101I and 102I form a roof-top type configuration that slopes from the vertex in two directions. The first direction of slope is radially interiorly toward the inner circumferential peak. The second direction of slope is circumferentially about the central axis of intermediate piston drive plug 58. Each pair of two angled surfaces 101I and 102I thus forms a "roof" for a corresponding interior protrusion tooth 96I, which includes an interior protrusion tooth face 104. The interior protrusion tooth 96I also includes opposing protrusion tooth edges 98I which co-terminate with the angled surfaces 101I and 102I, and which extend axially away from the mouth. Interiorly remote edges of two adjacent protrusion tooth edges 94I which are connected by a curved jaw surface 100. The six curved jaw surfaces 100 at least partially define a throat surface region of intermediate piston drive plug 58. The six interior protrusion tooth faces 104 are each curved in a manner whereby the six interior protrusion tooth faces 104 lies in a same imaginary inner circumferential surface about the central axis of intermediate piston drive plug 58. At a larger diameter than the imaginary inner circumferential surface in which the six interior protrusion tooth faces 104 lie, the cavities or slots 84I, such as cavities 84I(1) and 84I(2) shown in FIG. 10, are formed between two adjacent interior protrusion teeth 96I. For example, a cavity or slot 84I is defined at least partially by the protrusion tooth edges 98I of adjacent teeth 96I and the curved jaw surface 100I.

As shown in FIG. 5, the interior of intermediate piston drive plug 58 also has seals 110, to isolate the lubricator 40 from well pressure that may exist. Similarly, the intermediate piston 52 has seals 112 between it and the primary piston 50. The seals and 112 may be sealing rings, such as O-rings, which are accommodated in interior circumferential grooves. The exterior of intermediate piston drive plug 58 is provided with threads 94I which are counter-threaded relative to threads provided on an inner surface of drive cylinder 54.

FIG. 11 shows an example embodiment and mode of the intermediate piston 52 of the example embodiment and mode of FIG. 5. FIG. 11 particularly shows the piston alignment projections 80I provided on the outer circumferential surface 82I of intermediate piston 52. The piston alignment projections 80I comprise axially elongated fingers arranged in a first radial spacing about the circumferential surface of intermediate piston 52. The first spacing of the fingers essentially corresponds to a second radial spacing between the piston plug alignment cavities 84I on the intermediate piston drive plug 58. Each finger of the piston alignment projections 80I comprises two finger distal tip surfaces 121, 122 configured to taper axially in a manner whereby angles of the two finger distal tip surfaces 121, 122 are inverse to or complementary to angles of the ramp surfaces 101, 102 of two adjacent piston plug alignment cavities 84I.

The intermediate piston 52 comprises an enlarged diameter end 130. The enlarged diameter end 130 of intermediate piston 52 comprises circumferential grooves 132 which accommodate sealing devices 134. The grooves 132 may also optionally accommodate bearings or wear rings at one or both edges/sides of the grooves 132. As shown in FIG. 11, downstream from the enlarged diameter end 130 the intermediate piston 52 assumes a narrower diameter and in such narrower diameter portion further comprises milled protrusions or alignment projections 80I with the angled faces or fingertip surfaces 121, 122 and the axially ending faces 136.

As shown in FIG. 5, in an example two piston example embodiment and mode the primary piston drive plug 59 is threadedly engaged and locked to the intermediate piston 52. As understood with reference to the generic/representative drive plug L of FIG. 9A and the particular primary piston drive plug 59 shown in FIG. 12, the primary piston drive plug 59 also houses sealing devices and a self-aligning feature similar to intermediate piston drive plug 58.

It is again mentioned that the structure of primary piston drive plug 59 is similar in many respects to the structure of intermediate piston drive plug 58, with like elements or features having similar labeled reference numbers, but with a suffix "P" to denote the primary piston drive plug 59 rather than a suffix "I" which denoted the intermediate piston drive plug 58. Thus, for example, the primary piston drive plug 59 includes piston plug alignment cavities 84P, exterior threads 94P, teeth 96P, and ramp surfaces 101P and 102P.

Likewise, as also understood with reference to the generic/representative piston P of FIG. 9A and the particular primary piston 50 shown in FIG. 13, the primary piston 50 also houses sealing devices and a self-aligning feature similar to intermediate piston 52. The structure of primary piston 50 is similar in many respects to the structure of intermediate piston 52 with like elements or features having similar labeled reference numbers, but with a suffix "P" to denote the primary piston 50 rather than a suffix "I" which denoted the intermediate piston 52. Thus, for example, the primary piston 50 includes piston alignment projections 80P, finger distal tip surfaces 121P and 122P, enlarged diameter end 130P, circumferential grooves 132P which accommodate sealing devices 138 (see FIG. 5), and axially ending faces 136P.

Additionally, since FIG. 5 shows a two-stage telescoping arrangement, primary piston 50 includes external sealing devices 138. The primary piston 50 is externally machined to comprise smaller protrusions 80P but created in the same manner as the protrusions 80I on the intermediate piston 52. The primary piston 50 has a hex end 140 which is configured to engage with VR socket 142 and is pinned in place with engagement pin 144. At its end remote from primary piston 50 the VR Socket 142 has an internal retention device 146 which is configured and designed to retain the VR Plug 150 in place during transmission of the telescoping pistons, in a manner shown for example in FIG. 6.

The primary piston 50 is slidably engaged with and cylindrically surrounded by the intermediate piston 52, which in turn is slidably engaged with and cylindrically surrounded by the drive cylinder 54.

According to an example aspect of the technology disclosed herein, at least one of the following are selected to facilitate a predetermined torque load on the lubricator: (1) a number of the piston alignment projections and a number of the piston plug alignment cavities; (2) an axial length of the piston alignment projections and an axial length of the piston plug alignment cavities; and (3) material yield strength. The torque capacity may be adjusted by changing the parameters identified in one or more of (1), (2), and (3) above.

Advancement of the telescoping pistons is achieved by applying fluid or gas via fluid connection 160 which flows radially through a port 161 in the drive cylinder body to cavity 66. The cavity 66 is formed interior to the intermediate piston 52 and axially between tool engagement plug 48 and primary piston 50. Since the intermediate piston has a larger diameter than the primary piston 50, and since the fluid or gas is contained, upon introduction of the fluid or gas into cavity 66 pressure will build up and move the pistons 52 and 50 outward along the axis of the tool toward the wellhead 28. The intermediate piston 52, as it nears full extension, automatically engages with its intermediate piston drive plug 58 by virtue of the self-aligning feature on the intermediate piston 52 and the self-aligning feature provided on the intermediate piston drive plug 58. Continued pumping of fluid or gas into cavity 66 moves the intermediate piston 52 to the end of its stroke at a point at which the self-aligning drive feature of the intermediate piston 52 is fully made up. Additional pumped fluid or gas volume into cavity 66 automatically initiates movement of the primary piston 50 along the tool axis 56 to the wellhead 28. As the primary piston 50 nears its full stroke the self-aligning protrusion feature on the primary piston 50 engages with the self-aligning feature of the primary piston drive plug 59. Continued addition of fluid via port 160 into cavity 66 enables full extension of the telescoping pistons carrying the VR plug 150 to the wellhead 28.

FIG. 6 shows the lubricator 40 fixed to a gate valve 32A in a one gate valve example embodiment and mode, and the telescoping pistons 52 and 50 fully extended so that the VR plug 150 contacts a mating thread in the wellhead 28.

An increase in pressure indicates the VR Plug 150 has reached its destination and can now be threaded into the wellhead 28. Threading of the VR Plug 150 into the wellhead 28 is achieved by connecting a drive mechanism that can be operated manually, hydraulically, electrically or a hybrid of the foregoing, to the recess 78 in the tool engagement plug 48. The recess 78 may be square, for example.

With the intermediate piston 52 fully extended and engaged with the internal drive mechanism and rotationally locked and the primary piston 50 extended and engaged with its internal drive mechanism and rotationally locked in place, the tool engagement plug 48 may be rotated. The torque is transmitted via the faces 136 of the intermediate piston protrusions 80I against the faces or cavity walls 98I provided by the radial lateral surfaces of teeth 96I of the intermediate piston drive plug coming in contact rotationally. The torque is further transmitted through the primary piston 50 by the surfaces of the protrusions 80P on primary piston 50 and the faces or cavity walls 98P provided by the radial lateral surfaces of teeth 96P in the primary piston drive plug 59. Since all components are internally connected, the torque is transmitted through the VR plug socket 142 with hex internal profile and hex external profile of VR plug 150.

Retrieval of the lubricator telescoping pistons comprises applying fluid pressure, e.g., gas or air pressure, to retract port 170. From port 170 fluid is transmitted internally to piston cavity 68 and 69 via radial ports 174 and 175 shown in FIG. 5. Continued pumping in of fluid reacts against the piston diameters 176. Since piston area created by diameters 176 are larger than the annular area created by piston seal diameters 180 of the intermediate piston drive plug 58, the intermediate piston 52 retracts. Continued pumping of fluid into cavity 69 results in the retraction of the primary piston 50 since the area created by seal diameter 184 is greater than that created by the seal area formed by the diameters 188 of the piston drive plug 59. Use of differentials in cross sectional area between pressure surfaces and the ratios of each of these surfaces to their respective opposing pressure surfaces for causing piston movement is described, e.g., in U.S. Pat. No. 3,624,979 to PRZYBYLSKI, which is incorporated herein by reference in its entirety.

In one of its example aspects, the technology disclosed herein concerns a method of operating a lubricator such as lubricator 40 in conjunction with or for a well system. In an example, generic mode, the method comprises (1) driving at least one piston within the lubricator along a lubricator axis toward a piston plug and automatically aligning a piston alignment contour of a surface of the at least one piston with a piston plug alignment contour formed on a surface of a piston plug as the at least one piston mates with the at least one piston plug; and (2) retaining at least one piston within the at least one piston plug. In a method of the example embodiment and mode of FIG. 9A, for example, the method comprises driving at least one piston within the wellhead lubricator along a lubricator axis toward a piston plug and automatically aligning piston alignment projections formed on an outer circumferential surface of the at least one piston with piston plug alignment cavities formed on an interior surface of a piston plug as the at least one piston enters an interior of the piston plug. The method further comprises retaining at least a portion of the piston alignment projections in the piston plug.

In the above regard, with respect to FIG. 9A, the example mode may comprise driving at least one piston, i.e., piston P, within the wellhead lubricator 90 along a lubricator axis 56 toward a piston plug L and automatically aligning piston alignment projections 80 formed on an outer circumferential surface of the at least one piston P with piston plug alignment cavities 84 formed on an interior surface of the 574 piston plug L as the at least one piston P enters an interior of the piston plug L. The method further comprises retaining at least a portion of the piston alignment projections 80 in the piston plug L. In the example method mode, the piston P may be one or both of primary piston 50 and intermediate piston 52, and the piston plug L may be one or both of primary piston drive plug 59 and intermediate piston drive plug 58.

In a more detailed description of an example mode which utilizes plural pistons, the at least one piston is an intermediate piston such as intermediate piston 52 and the piston plug is an intermediate piston plug such as intermediate piston plug 58. The more detailed method further comprises: (1) providing a primary piston such as piston 50 axially slidable within the intermediate piston 52, the primary piston 50 comprising primary piston alignment projections 80P on an outer circumferential surface of the primary piston; (2) providing a primary piston plug such as primary piston plug 59 configured to limit an extent of axial displacement of the primary piston 50, the primary piston plug comprising primary piston plug alignment cavities 84P on an interior surface of the primary piston plug; (3) driving the primary piston 50 along the axis and axially beyond the intermediate piston 52; and, automatically aligning the primary piston alignment projections 80P and the primary piston plug alignment cavities 84P circumferentially about the axis as the at least one primary piston enters an interior of the primary piston plug and is retained in position in the primary piston plug.

The automatic circumferential alignment of a piston P with its respective piston plug L (see FIG. 9A) is facilitated by the essentially complementary angles of the fingertip distal tip surfaces 121, 122 of piston alignment projections 80 of the piston P and the ramp surfaces 101 and 102 of the teeth 96 in cavities 84 of the piston plug L. In view of the complementary angled surfaces, as the piston P is driven toward the plug L along the axis 56, the complementary angled surfaces cause the piston P to rotate about the axis so to a position that the piston alignment projections 80 of the piston are guided into the respectively cavities 84 of the plug L. With the piston alignment projections 80 of the piston P inserted into the cavities 84 of the plug L, the piston alignment 602 projections 80 are engaged within the cavities so that the piston P and plug L may be rotated in unison.

In a non-limiting example embodiment and mode, the circumferential angle of the ramp surfaces 101 and 102 of the teeth 96 in cavities 84 of the piston plug L is preferably 30 degrees, plus or minus 5 degrees, while the radial angle of the ramp surfaces 101 and 102 of the teeth 96 in cavities 84 of the piston plug L is preferably 50 degrees, plus or minus 2 degrees. Both the circumferential angle and the radial angle are specified with reference to the piston/plug axis 56 that is parallel to the driving motion the reference. The circumferential angle of fingertip distal tip surfaces 121, 122 of piston alignment projections 80 of the piston P is preferably 30 degrees, plus or minus 5 degrees. Smaller circumferential angles are also possible, but large circumferential angles may require more physical rotation in order to mate the complementary components. In an example embodiment and mode, the circumferential angles of the ramp surfaces 101, 102 and the circumferential angles of the distal tip surfaces 121, 122 should be approximately the same.

The self-aligning feature comprises a series of channels (female) and a series of upsets (male) manufactured into components that when mated they allow for the transmission of load (torque). The features are such that they have mouth wide enough and angled sufficiently that they allow for the upsets (male) parts with similarly shaped geometry so that when they engage, they also automatically align. With further extension of the TVRL the Upsets (male) fully engage with the channels (female) providing the means of transmission of load (torque).

Figure 14:
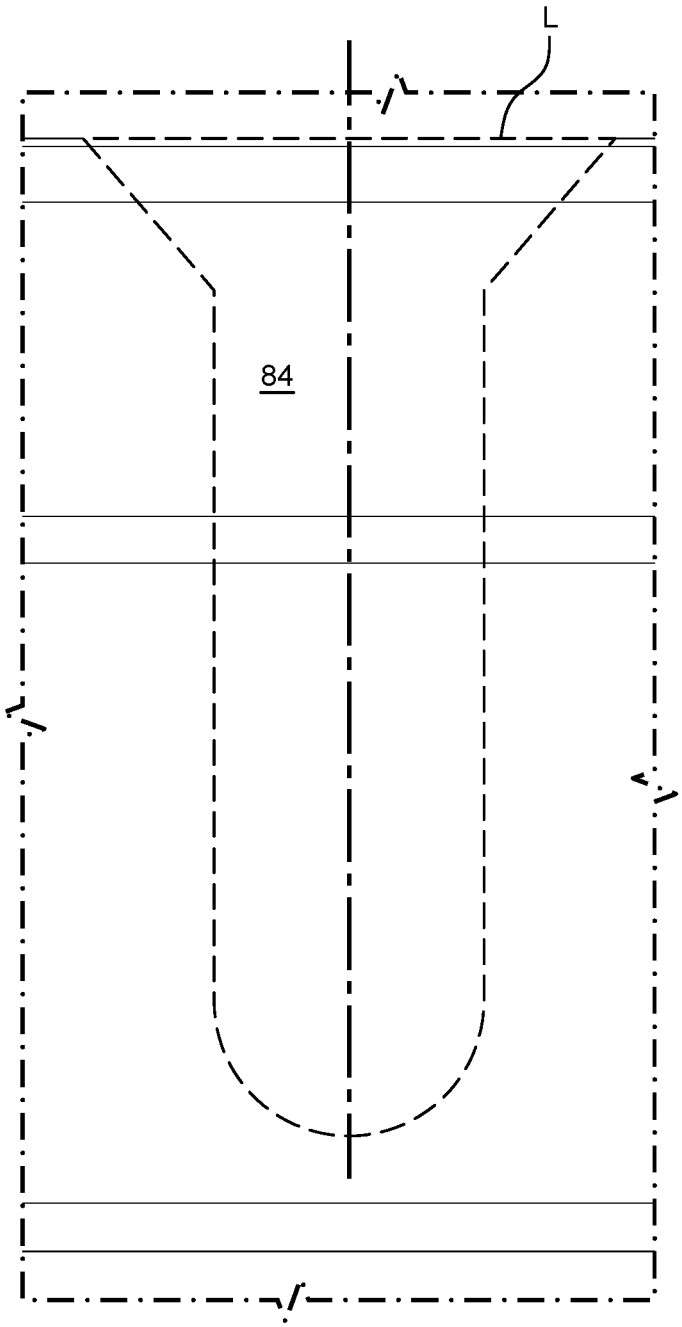
FIG. 14 is a diagrammatic view depicting aspects of a portion of a piston plug of the example embodiment and mode of FIG. 5.

FIG. 14 is a diagrammatic view showing features of the piston plug L and particularly aspects of the piston plug cavity 84. The mouth geometry of the channels (female) is such that the entry is produced wider than the upsets (male). The channels are equally spaced around the periphery (internal Diameter) of the component. The depth and width of the channels are dependent on the component diameter and wall thickness available.

Figure 15:
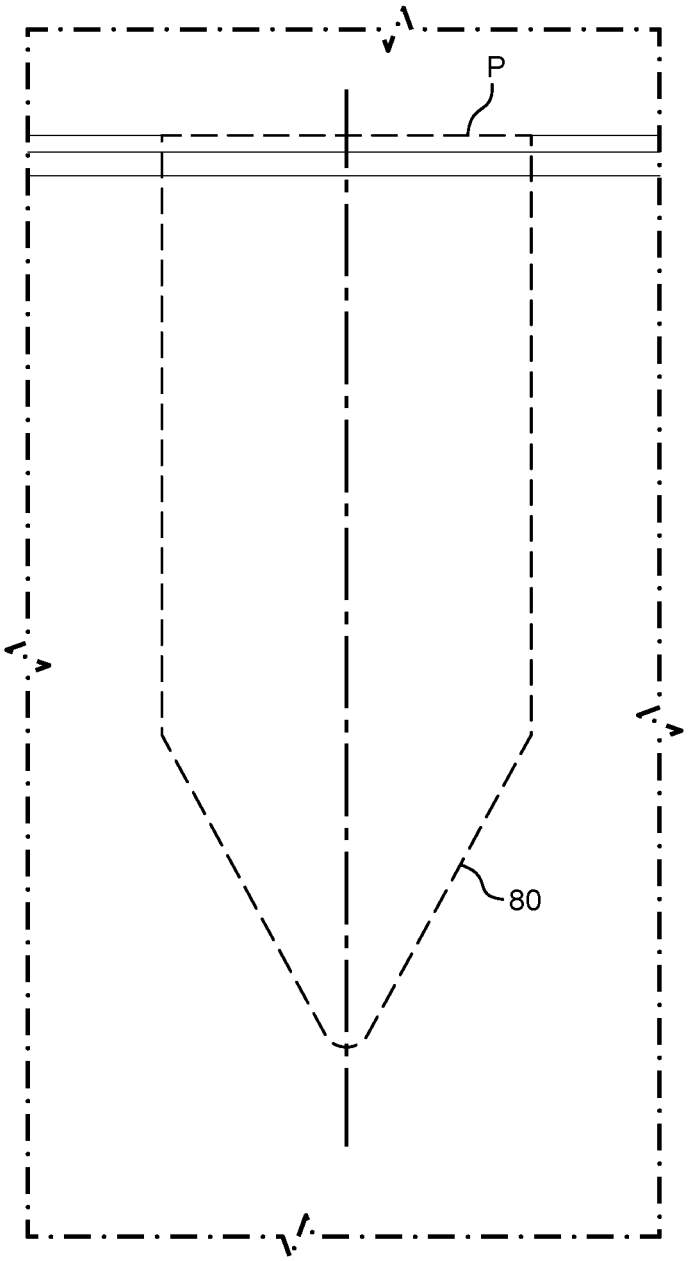
FIG. 15 is a diagrammatic view depicting aspects of a portion of a piston of the example embodiment and mode of FIG. 5.

FIG. 15 is a diagrammatic view showing features of the piston P and particularly aspects of the piston alignment projections 80. The upsets (male) are formed in a similar shape to ensure engagement with the channels. There can be one upset or multiple upsets equal to the number of channels. The number of upsets will depend on the load (torque) requiring to be transmitted but cannot be greater than the number of channels. The depth (height) of the upset is driven from the depth achieved in the channels.

The geometry shown in FIG. 14 and FIG. 15 is for an example intermediate piston 52. The primary piston 50 may have similar geometry (scaled to suit the diameter available) and may perform in exactly the same manner as the intermediate piston arrangement.

FIG. 7 and FIG. 8 show the VR plug 150 installed threadedly into the wellhead 28. FIG. 7 shows the VR plug 150 installed in a single gate valve example embodiment and mode, FIG. 8 shows the VR plug 150 installed in a two gate valve example embodiment and mode The VR plug 150 and may now be pressure tested to ensure a leak tight fit.

A pressure check or monitoring of the VR plug 150 may be done by pumping fluid in through pressure-check/bleed port 190, shown in FIG. 5, until the desired test pressure is reached. The pumping fluid applied through port 190 may be applied for extended period of time before reducing pressure to 0 psi and removing the lubricator 40. At that point one or more of the valve(s) 30 may be removed or refurbished and the wellhead returned to full operational condition.

FIG. 8 shows the lubricator 40 of an example embodiment and mode fixed to the outermost flange 34 of the outboard valve 32B mounted in tandem with a second valve 32A delivering a VR plug 150 to the wellhead 28 utilizing extension piece(s) 200 to increase the stroke of the lubricator 40. The extension 200 may be threaded together and pinned to lock rotationally, or it may be Hex extrusions either end with pin feature to lock in place and allow for torque transmission. The extension piece(s) 200 may comprise structure that may enable a user to take the same lubricator and mount it to two valves and still be able to install or retrieve a VR Plug. It uses standard connection methods to transmit the torque.

Thus, the scope of the technology disclosed herein should be determined by the appended claims and their legal equivalents. Therefore, it will be appreciated that the scope of the technology disclosed herein fully encompasses other embodiments which may become obvious to those skilled in the art, and that the scope of the technology disclosed herein is accordingly to be limited by nothing other than the appended claims, in which reference to an element in the singular is not intended to mean "one and only one" unless explicitly so stated, but rather "one or more." The above-described embodiments could be combined with one another. All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the technology disclosed herein, for it to be encompassed by the present claims. Furthermore, no element, component, or method step in the present disclosure is intended to be dedicated to the public regardless of whether the element, component, or method step is explicitly recited in the claims.

What is claimed is:

1. A lubricator for a well system, the lubricator comprising:

at least one piston axially slidable within the lubricator along a lubricator axis, the at least one piston comprising a plurality of piston alignment contour features circumferentially provided on a surface of the at least one piston;

a piston plug configured to limit an extent of axial displacement of the at least one piston, the piston plug comprising a plurality of piston plug alignment contour features circumferentially provided on a surface of the piston plug; and wherein the plurality of piston alignment contour features and the piston plug alignment contour features are configured to mate and automatically circumferentially align the at least one piston and the at least one piston plug about the axis upon travel of at least part of the at least one piston along the axis completely through an interior of the at least one piston plug, whereby travel of the at least one piston along the axis beyond the piston plug is limited by the piston plug.

2. The lubricator of claim 1, further comprising:

an essentially cylindrical and essentially hollow housing positioned about the lubricator axis;

a lubricator adaptor flange configured for attachment to a valve;

an essentially cylindrical drive cylinder at least partially axially extending through an interior of the housing; and wherein the at least one piston is axially slidable relative to the drive cylinder.

3. The lubricator of claim 1, wherein the plurality of piston alignment contour features comprises a plurality of piston alignment projections on an outer circumferential surface of the at least one piston; wherein the plurality of piston plug alignment contour features of the surface of the piston plug comprises a plurality of piston plug alignment cavities on an interior surface of the piston plug; and wherein the plurality of one piston alignment projections and the plurality of piston plug alignment cavities are configured so that upon travel of the at least one piston along the axis the plurality of piston alignment projections mate with the plurality of piston plug alignment cavities to automatically circumferentially align about the axis the at least one piston in position in the piston plug.

4. The lubricator of claim 3, wherein the piston plug alignment cavities are formed between adjacent teeth provided on an interior surface of the piston plug, each cavity being at least partially defined in a radial direction by a cavity wall provided by one of the adjacent teeth, and wherein a tooth provided on the interior surface of the piston plug comprises two ramp surfaces that are angled axially from a tooth peak at a mouth rim of the piston plug, one of the two ramp surfaces being connected to a first cavity on a first side of the tooth and the second ramp surface being connected to a second cavity on a second side of the tooth.

5. The lubricator of claim 4, wherein each cavity is further at least partially defined by a portion of an interior surface of the piston plug.

6. The lubricator of claim 5, the interior surface of the piston plug is in a shape of a polygon in a plane perpendicular to the axis, and wherein each tooth has a tooth cap which is situated essentially at a vertex of the polygon.

7. The lubricator of claim 4, wherein the piston alignment projections on the outer circumferential surface of the at least one piston comprise axially elongated fingers arranged in a first radial spacing about the circumferential surface of the at least one piston, the first spacing of the fingers essentially corresponding to a second radial spacing between the piston plug alignment cavities on the piston plug, and wherein each finger of the piston alignment projections comprises two finger distal tip surfaces configured to taper axially in a manner whereby angles of the two finger distal tip surfaces are inverse to angles of the ramp surfaces of two adjacent piston plug alignment cavities.

8. The lubricator of claim 4, wherein the teeth provided on the interior surface of the piston plug have an arcuate face and the faces of plural teeth at least partially form an imaginary cylinder about the axis at a diameter sufficient to accommodate the at least one piston.

9. The lubricator of claim 4, wherein at least one of the following are selected to facilitate a predetermined torque load on the lubricator:

a number of the piston alignment projections and a number of the piston plug alignment cavities;

an axial length of the piston alignment projections and an axial length of the piston plug alignment cavities.

10. The lubricator of claim 3, wherein the at least one piston is an intermediate piston, and wherein the piston plug is an intermediate piston plug, and further comprising:

a primary piston axially slidable within the intermediate piston, the primary piston comprising primary piston alignment projections on an outer circumferential surface of the primary piston;

a primary piston plug configured to limit an extent of axial displacement of the primary piston, the primary piston plug comprising primary piston plug alignment cavities on an interior surface of the primary piston plug; and wherein the primary piston alignment projections and the primary piston plug alignment cavities are configured so that upon travel of the primary piston along the axis and axially beyond the intermediate piston the primary piston alignment projections automatically align circumferentially about the axis as the plurality of piston alignment projections of the primary piston travels through an interior of the primary piston plug and are retained in position in the primary piston plug.

11. The lubricator of claim 1, wherein the plurality of piston alignment contour features comprise a plurality of piston alignment cavities at a circumferential surface of the at least one piston;

wherein the plurality of piston plug alignment contour features of the surface of the piston plug comprise a plurality of piston plug alignment projections at a surface of the piston plug; and wherein the plurality of piston plug alignment projections and the plurality of piston alignment cavities are configured so that upon travel of the at least one piston along the axis the plurality of piston alignment cavities mate with the plurality of piston alignment projections to automatically circumferentially align the at least one piston in position in the piston plug.

12. A method of operating a lubricator for a well system, the method comprising:

driving at least part of at least one piston within the lubricator along a lubricator axis completely through an interior of a piston plug;

mating a plurality of piston alignment contour features provided on a surface of the at least one piston with a plurality of piston plug alignment contour features formed on a surface of a piston plug to automatically circumferentially align a bout the axis as the at least one piston with the at least one piston plug; and using the at least one piston plug to limit travel of the at piston along the lubricator axis.

13. The method of claim 12, further comprising:

attaching the lubricator to a valve, the valve being connected to a wellhead of the well system;

upon limiting the travel of the at least one piston using the piston plug, rotating the at least one piston to perform a maintenance operation within the well system.

14. The method of claim 12, wherein the piston alignment contour features comprise a plurality of piston alignment projections formed on an outer circumferential surface of the at least one piston and the piston plug alignment contour features comprise a plurality of piston plug alignment cavities formed on an interior surface of a piston plug, and wherein the method further comprises:

while driving the at least one piston within the lubricator along the lubricator axis toward the piston plug, mating the plurality of piston alignment projections formed on the outer circumferential surface of the at least one piston with the plurality of piston plug alignment cavities formed on the interior surface of the piston plug to automatically circumferentially align the at least one piston with the at least one piston plug.

15. The method of claim 14, wherein mating the piston alignment projections and the piston plug alignment cavities circumferentially about the axis comprises forming the piston plug alignment cavities between adjacent teeth provided on an interior surface of the piston plug whereby:

each cavity is at least partially defined in a radial direction by a cavity wall provided by one of the adjacent teeth;

a tooth provided on the interior surface of the piston plug comprises two ramp surfaces that are angled axially from a tooth peak at a mouth rim of the piston plug;

one of the two ramp surfaces is connected to a first cavity on a first side of the tooth and the second ramp surface being connected to a second cavity on a second side of the tooth.

16. The method of claim 15, wherein each cavity is further at least partially defined by portion of an interior surface of the piston plug.

17. The method of claim 16, the interior surface of the piston plug is in a shape of a polygon in a plane perpendicular to the axis, and wherein each tooth has a tooth cap which is situated essentially at a vertex of the polygon.

18. The method of claim 15, further comprising:

forming the piston alignment projections on the outer circumferential surface of the at least one piston to comprise axially elongated fingers arranged in a first radial spacing about the circumferential surface of the at least one piston, the first spacing of the fingers essentially corresponding to a second radial spacing between the piston plug alignment cavities, and forming each finger of the piston alignment projections to comprise two finger distal tip surfaces configured to taper axially in a manner whereby angles of the two finger distal tip surfaces are inverse to angles of the ramp surfaces of two adjacent piston plug alignment cavities.

19. The method of claim 15, further comprising forming the teeth provided on the interior surface of the piston plug to have an arcuate face and the faces of plural teeth to at least partially form an imaginary cylinder about the axis at a diameter sufficient to accommodate the at least one piston.

20. The method of claim 15, further comprising selecting at least one of the following are selected to facilitate a predetermined torque load on the lubricator:

a number of the piston alignment projections and a number of the piston plug alignment cavities;

an axial length of the piston alignment projections and an axial length of the piston plug alignment cavities.

21. The method of claim 12, wherein the at least one piston is an intermediate piston, and wherein the piston plug is an intermediate piston plug, and wherein the method further comprises:

providing a primary piston axially slidable within the intermediate piston, the primary piston comprising primary piston alignment projections on an outer circumferential surface of the primary piston;

providing a primary piston plug configured to limit an extent of axial displacement of the primary piston, the primary piston plug comprising primary piston plug alignment cavities on an interior surface of the primary piston plug;

driving the primary piston along the axis and axially beyond the intermediate piston; and mating the primary piston alignment projections and the primary piston plug alignment cavities circumferentially about the axis to align the primary piston plug in position in the primary piston plug.

22. The method of claim 12, wherein the piston alignment contour features comprise a plurality of piston alignment cavities formed at a circumferential surface of the at least one piston and the piston plug alignment contour features comprise a plurality of piston plug alignment projections formed at a surface of a piston plug, and wherein the method further comprises:

while driving the at least one piston within the lubricator along the lubricator axis toward the piston plug, mating the plurality of piston alignment cavities formed at the surface of the at least one piston with the plurality of piston plug alignment projections formed on the surface of the piston plug to automatically circumferentially align about the axis the at least one piston with the at least one piston plug.

23. A lubricator for a well system, the lubricator comprising:

at least one piston axially slidable within the lubricator along a lubricator axis, the at least one piston comprising a piston alignment contour of a surface of the at least one piston;

a piston plug configured to limit an extent of axial displacement of the at least one piston, the piston plug comprising a piston plug alignment contour of a surface of the piston plug; and wherein the piston alignment contour and the piston plug alignment contour are configured to mate and automatically circumferentially align the at least one piston and the at least one piston plug about the axis upon travel of the at least one piston along the axis toward the at least one piston plug, wherein the piston alignment contour of the surface of the at least one piston comprises at least one piston alignment projection on an outer circumferential surface of the at least one piston;

wherein the piston plug alignment contour of the surface of the piston plug comprises piston plug alignment cavities on an interior surface of the piston plug; wherein the piston plug alignment cavities are formed between adjacent teeth provided on an interior surface of the piston plug, each cavity being at least partially defined by a cavity wall provided by one of the adjacent teeth;

wherein a tooth provided on the interior surface of the piston plug comprises two ramp surfaces that are angled axially from a mouth rim of the piston plug, one of the two ramp surfaces being connected to a first cavity on a first side of the tooth and the second ramp surface being connected to a second cavity on a second side of the tooth;

wherein each cavity is further at least partially defined by a portion of an interior surface of the piston plug, the interior surface of the piston plug is in a shape of a polygon in a plane perpendicular to the axis; and wherein each tooth comprises a tooth cap which is situated essentially at a vertex of the polygon.

24. A lubricator for a well system, the lubricator comprising:

at least one piston axially slidable within the lubricator along a lubricator axis, the at least one piston comprising a piston alignment contour of a surface of the at least one piston;

a piston plug configured to limit an extent of axial displacement of the at least one piston, the piston plug comprising a piston plug alignment contour of a surface of the piston plug; and wherein the piston alignment contour and the piston plug alignment contour are configured to mate and automatically circumferentially align the at least one piston and the at least one piston plug about the axis upon travel of the at least one piston along the axis toward the at least one piston plug;

wherein the piston alignment contour of the surface of the at least one piston comprises at least one piston alignment projection on an outer circumferential surface of the at least one piston;

wherein the piston plug alignment contour of the surface of the piston plug comprises piston plug alignment cavities on an interior surface of the piston plug;

wherein the piston plug alignment cavities are formed between adjacent teeth provided on an interior surface of the piston plug, each cavity being at least partially defined by a cavity wall provided by one of the adjacent teeth;

wherein a tooth provided on the interior surface of the piston plug comprises two ramp surfaces that are angled axially from a mouth rim of the piston plug, one of the two ramp surfaces being connected to a first cavity on a first side of the tooth and the second ramp surface being connected to a second cavity on a second side of the tooth;

wherein the piston alignment projections on the outer circumferential surface of the at least one piston comprise axially elongated fingers arranged in a first radial spacing about the circumferential surface of the at least one piston, the first spacing of the fingers essentially corresponding to a second radial spacing between the piston plug alignment cavities on the piston plug, and wherein each finger of the piston alignment projections comprises two finger distal tip surfaces configured to taper axially in a manner whereby angles of the two finger distal tip surfaces are inverse to angles of the ramp surfaces of two adjacent piston plug alignment cavities.

* * * * *